US011448009B2

(12) United States Patent
Otsuka et al.

(10) Patent No.: US 11,448,009 B2
(45) Date of Patent: Sep. 20, 2022

(54) SHADING DEVICE

(71) Applicant: NICHIBEI CO., LTD., Tokyo (JP)

(72) Inventors: Hideki Otsuka, Tokyo (JP); Masaki Nakajima, Tokyo (JP)

(73) Assignee: Nichibei Co., Ltd., Tokyo (JP)

( * ) Notice: Subject to any disclaimer, the term of this patent is extended or adjusted under 35 U.S.C. 154(b) by 22 days.

(21) Appl. No.: 16/972,324

(22) PCT Filed: Apr. 5, 2019

(86) PCT No.: PCT/JP2019/015153
§ 371 (c)(1),
(2) Date: Dec. 4, 2020

(87) PCT Pub. No.: WO2020/026527
PCT Pub. Date: Feb. 6, 2020

(65) Prior Publication Data

US 2021/0230939 A1 Jul. 29, 2021

(30) Foreign Application Priority Data

Jul. 31, 2018 (JP) ..... JP2018-143424
Aug. 1, 2018 (JP) ..... JP2018-145150

(51) Int. Cl.
*E06B 9/322* (2006.01)
*E06B 9/262* (2006.01)

(52) U.S. Cl.
CPC ..... *E06B 9/322* (2013.01); *E06B 9/262* (2013.01); *E06B 2009/3225* (2013.01)

(58) Field of Classification Search
CPC .... E06B 2009/2441; E06B 9/32; E06B 9/322; E06B 9/324; E06B 9/262; E06B 2009/3225; E06B 2009/2625; E06B 9/325
See application file for complete search history.

(56) References Cited

U.S. PATENT DOCUMENTS 6,076,587 A * 6/2000 Pastor ..... E06B 9/307 160/115
9,988,837 B2 * 6/2018 Defenbaugh ..... E06B 9/322
(Continued)

FOREIGN PATENT DOCUMENTS

CA 2982632 A1 * 4/2018 ..... E06B 9/326
CN 112901049 * 6/2021 ..... E06B 9/322
(Continued)

OTHER PUBLICATIONS

Corresponding International Patent Application No. PCT/JP2019/015153, International Search Report and Written Opinion, dated May 28, 2019. English Translation.
(Continued)

*Primary Examiner* — Johnnie A. Shablack
*Assistant Examiner* — Matthew R. Shepherd
(74) *Attorney, Agent, or Firm* — Cooper Legal Group LLC

(57) ABSTRACT

A shading device including a first driving shaft that is rotatably supported within a headbox and may drive a first moving member and a second driving shaft that is rotatably supported within the headbox and may drive a second moving member, the shading device includes a first pulley that drives the first driving shaft, and a second pulley that is disposed at a position different from the first pulley in a longitudinal direction of the headbox and drives the second driving shaft.

20 Claims, 24 Drawing Sheets

(56) References Cited

U.S. PATENT DOCUMENTS

| | | | | |
|---|---|---|---|---|
| 10,871,029 | B2 * | 12/2020 | Ter Haar | E06B 9/262 |
| 2004/0074611 | A1 * | 4/2004 | Colson | E06B 9/262 160/84.05 |
| 2008/0053626 | A1 * | 3/2008 | Jarosinski | E06B 9/322 160/168.1 P |
| 2009/0242332 | A1 * | 10/2009 | Anderson | E06B 9/322 185/37 |
| 2009/0308547 | A1 * | 12/2009 | Kwak | E06B 9/42 160/368.1 |
| 2011/0265962 | A1 * | 11/2011 | Drew | E06B 9/262 160/340 |
| 2013/0056162 | A1 | 3/2013 | Aoki | |
| 2015/0144275 | A1 * | 5/2015 | Ganzi | E06B 9/32 160/84.03 |
| 2015/0354275 | A1 * | 12/2015 | Huang | E06B 9/32 160/368.1 |
| 2016/0222725 | A1 * | 8/2016 | Morris | E06B 9/262 |
| 2016/0281423 | A1 * | 9/2016 | Kao | E06B 9/42 |
| 2018/0010384 | A1 * | 1/2018 | Huang | E06B 9/322 |
| 2019/0234140 | A1 * | 8/2019 | Valkenburg | E06B 9/262 |

FOREIGN PATENT DOCUMENTS

| | | | | |
|---|---|---|---|---|
| DE | 102009041699 | * | 1/2011 | E06B 9/262 |
| JP | 2010112048 | * | 5/2010 | E06B 9/262 |
| JP | 2010112049 | A | 5/2010 | |
| JP | 2011220077 | A | 11/2011 | |
| JP | 5107869 | B2 * | 12/2012 | E06B 9/303 |
| JP | 2018071198 | A | 5/2018 | |
| WO | 2012150946 | A2 | 11/2012 | |

OTHER PUBLICATIONS

Corresponding European Patent Application 19843079.5—Extended European Search Report dated Mar. 21, 2022.

* cited by examiner

SHADING DEVICE

FIELD

The present embodiment relates to a shading device.

BACKGROUND ART

Shading devices in which two shading members are arranged in parallel, such as blinds, curtains, and partitions, have been known. Such shading devices lift and lower a bottom rail disposed at the lowest end and an intermediate bar disposed between the bottom rail and a headbox separately, thereby lifting and lowering a first shading member disposed between the bottom rail and the intermediate bar and a second shading member disposed between the intermediate bar and the headbox, respectively.

For a shading device having two such shading members, the shading device shown in Patent Literature 1 below is known. The shading device includes an operating device including an endless operating cord, a pulley around which the operating cord is wound, an operating shaft connected with the pulley to rotate together and capable of rotating upon receiving an operation force, a clutch capable of rotating integrally with the operating shaft and axially sliding on the operating shaft, and a first transmission member disposed at one axial side of the clutch to transmit driving force to a first driving shaft for lifting and lowering the first shading member and a second transmission member disposed at the other axial side of the clutch to transmit driving force to a second driving shaft for lifting and lowering the second shading member, where the sliding direction of the clutch is determined by the rotational direction of the operating shaft, such that as the clutch sliding on the operating shaft is engaged with one of the transmission members, the rotation of the operating shaft is transmitted to any one of the driving shafts through one of the transmission members.

According to such a shading device, the operating shaft is operated to rotate in either direction by one operating cord, and the rotational direction determines the sliding direction of the clutch. The transmission member to which the rotation is transmitted is switched between the first transmission member and the second transmission member by the sliding direction of the clutch, and the rotation may be thereby transmitted to either driving shaft by one clutch unit. As a result, the number of parts of the operation device of the shading device is reduced to achieve space saving.

CITATION LIST

Patent Literature

Patent literature 1: JP2011-220077A

SUMMARY OF INVENTION

Technical Problem

According to the shading device described in Patent literature 1, a single operation cord is vertically hanging from two points on the room side and the window side in the front and rear direction of the shading device, and the positions where the operation cord is hanging are substantially aligned in the width direction of the shading device, i.e., the longitudinal direction of the headbox. As such, there has been a problem that it is difficult to distinguish between the vertically hanging operation cord on the room side and the vertically hanging operation cord on the window side, especially in the situation where the vertically hanging operation cord is twisted and the front side and the rear side of the operation cord are replaced.

The present invention has been made to solve the problems, and an object of the present invention is to allow two types of operation cords to be hanging from a headbox so as to be easily distinguished.

Solution to Problem

To solve the above-described problems, a shading device according to one aspect of the present invention includes a first driving shaft that is rotatably supported within a headbox and may drive a first moving member and a second driving shaft that is rotatably supported within the headbox and may drive a second moving member, and includes a first pulley that drives the first driving shaft and a second pulley that is disposed at a position different from the first pulley in a longitudinal direction of the headbox and drives the second driving shaft.

Advantageous Effects of Invention

According to the present invention, a shading device capable of hanging two types of operation cords from a headbox in a distinguishable manner may be provided. Other effects of the present invention will also be described in Description of Embodiments below.

BRIEF DESCRIPTION OF THE DRAWINGS

FIG. 31(*b*) is a cross-sectional view taken along line A-A of FIG. 27 showing an operation state of the first operation cord;

FIG. 32(*b*) is a cross-sectional view taken along line B-B of FIG. 27 showing an operation state of the second operation cord;

DESCRIPTION OF EMBODIMENTS

First Embodiment

Figure 1:
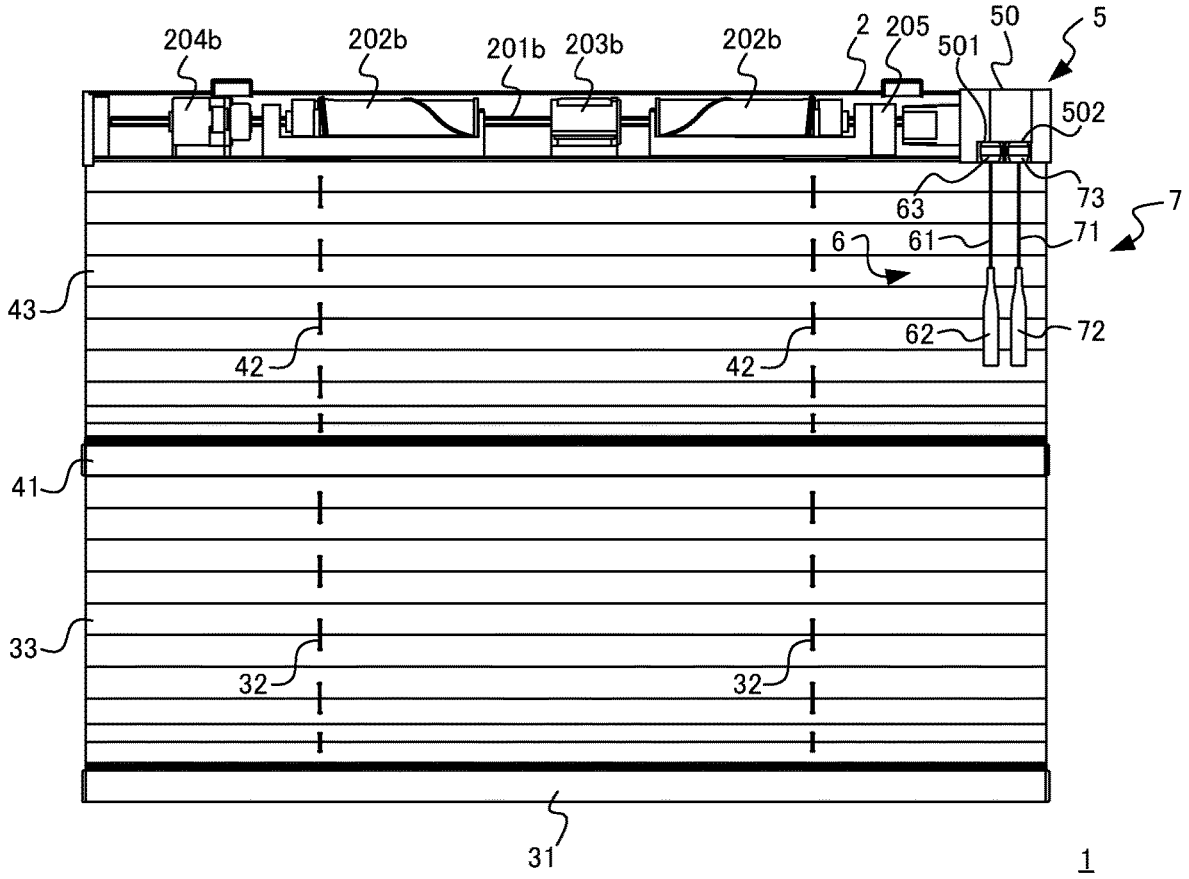
FIG. 1 is a front view showing a configuration of the shading device according to a first embodiment.

First embodiment of the present invention will be described hereafter with reference to the drawings. In this embodiment, a room side surface when the shading device is provided is referred to as a front surface, an exterior side surface is referred to as a rear surface, a direction perpendicular to the front surface and the rear surface is referred to as a front-rear direction, and the longitudinal direction of the shading device is referred to as a left-right direction. Further, in the present specification and drawings, elements having substantially the same function are denoted by the same reference numerals and their duplicate descriptions are omitted.

(Overall configuration)

Figure 2:
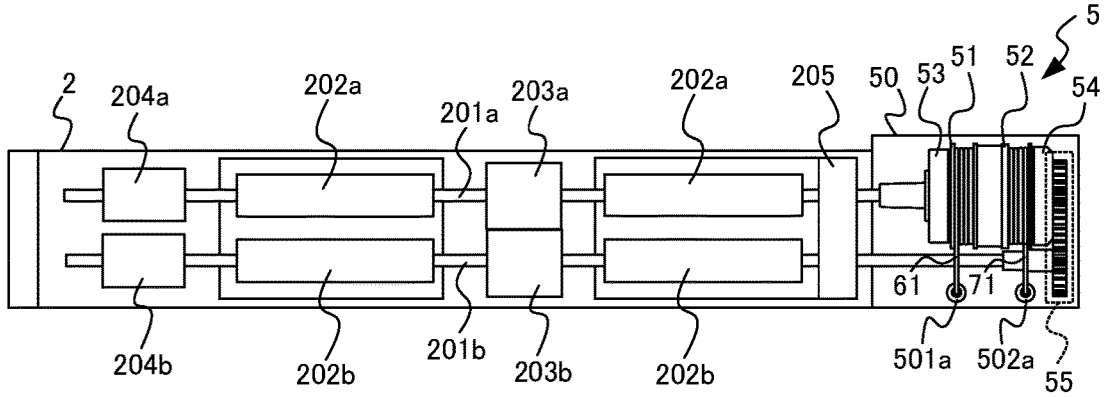
FIG. 2 is a schematic plan perspective view showing a configuration of the shading device according to the first embodiment.

The overall configuration of a shading device provided with an operating device according to this embodiment will be described. FIGS. 1 and 2 respectively are a front view and a schematic plan perspective view of the shading device according to the present embodiment. In FIG. 1, only a headbox is shown in a longitudinal section.

As shown in FIGS. 1 and 2, the shading device 1 according to the present embodiment is a horizontal pleated screen and includes a headbox 2, a bottom rail 31 as a first moving member, two lifting/lowering cords 32 formed in a string or tape form, a screen 33 as a first shading member, an intermediate bar 41 as a second moving member, two light control cords 42 formed in a string or tape form, a screen 43 as a second shading member, an operating device 5, a first operation cord 6, and a second operation cord 7.

The headbox 2 is fixed to a window frame, for example, with brackets (not shown) and is formed in an elongated box shape having a housing space therein. In the headbox 2, a first driving shaft 201*a*, two first winding drums 202*a*, a first stopper 203*a*, a first brake 204*a*, a second driving shaft 201*b*, two second winding drums 202*b*, a second stopper 203*b*, a second brake 204*b*, and an interlocking gear 205 are housed. The first driving shaft 201*a*, the two first winding drums 202*a*, the first stopper 203*a*, and the first brake 204*a* constitute a first drive system for lifting and lowering the bottom rail 31. The second driving shaft 201*b*, the two second winding drums 202*b*, the second stopper 203*b*, and the second brake 204*b* constitute a second drive system for lifting and lowering the intermediate bar 41. The interlocking gear 205 is configured to interlock the second drive system with the first drive system under predetermined conditions. In this embodiment, the first drive system is disposed on the rear side, the second drive system is disposed on the front side, and the first drive system and the second drive system are arranged in parallel with each other in the front-rear direction. In this regard, for example, the first drive system and the second drive system may be arranged in parallel in the vertical direction, or the arrangement of the first drive system and the second drive system may be reversed in the front-rear direction or the vertical direction.

The first driving shaft 201*a* and the second driving shaft 201*b* are each prismatic members extending in the left-right direction, and are supported rotatably in the axial direction to the left-right direction within the headbox 2. The shaft center of the first driving shaft 201*a* is positioned behind the shaft center of the second driving shaft 201*b*, and the shaft centers are at the different positions in the front-rear direction. In the following description, the shaft center of the first driving shaft 201*a* is referred to as a first shaft center, and the shaft center of the second driving shaft 201*b* is referred to as a second shaft center.

The two first winding drums 202*a* are each penetrated by the first driving shaft 201*a* to rotate integrally with the first driving shaft 201*a*, and one ends of the corresponding lifting/lowering cords 32 are coupled so as to be wound around and unwound from the first winding drums 202*a*. The two second winding drums 202*b* are each penetrated by the second driving shaft 201*b* to rotate integrally with the second driving shaft 201*b*, and one ends of the corresponding light control cords 42 are coupled so as to be wound around and unwound from the second winding drums 202*b*. The first stopper 203*a* restrains the rotation of the first driving shaft 201*a*. The second stopper 203*b* restrains the rotation of the second driving shaft 201*b*. The first brake 204*a* decelerates the rotation of the first driving shaft 201*a*. The second brake 204*b* decelerates the rotation of the second driving shaft 201*b*.

The bottom rail 31 is a member formed long in the right and left direction. The bottom rail 31 is connected to the other ends of the two lifting/lowering cords 32, and supported by and hung from the headbox 2 so as to be located at the lowest end of the shading device 1. The intermediate bar 41 is a member formed long in the right and left direction. The intermediate bar 41 is connected to the other ends of the two light control cords 42, and supported by and hung from the headbox 2 so as to be located between the headbox 2 and the bottom rail 31 in the vertical direction. The screen 33 is a shading member that is connected to the lower surface of intermediate bar 41 at the upper end, and connected to the upper surface of bottom rail 31 at the lower end. The screen 33 is formed in a pleated form that is vertically foldable and the two lifting/lowering cords 32 are partially inserted into the screen 33 in the vertical direction. The screen 43 is a shading member that is connected to the lower surface of headbox 2 at the upper end, and connected to the upper surface of the intermediate bar 41 at the lower end. The screen 43 is formed in a pleated form that is vertically foldable and the two light control cords 42 are partially inserted into the screen 43 in the vertical direction.

The operation device 5 is disposed at one of the right end and the left end of the headbox 2, at the right end of the headbox 2 in this embodiment, and includes a case 50 having a housing space formed therein, a first pulley 51, a second pulley 52, a first clutch mechanism 53, a second clutch mechanism 54, and a transmission mechanism 55. These components will be described in detail below.

The first operation cord 6 includes a cord member 61 formed in a string or a tape and connected at one end to the first pulley 51 to be wound around and unwound from, a gripping portion 62 provided at the other end of the cord member 61, and a stopper 63 fixed at a predetermined position between one end and the other end. The gripping portion 62 is a member for an operator of the shading device 1 to operate the first operation cord 6, in particular, to pull the first operation cord 6 downward so that the cord member 61 is unwound from the first pulley 51. The stopper 63 prevents the cord member 61 from being wound by the first pulley 51 to a predetermined amount or more. The structure of the cord member 61 and the stopper 63 may be such that the two different cords are connected within the stopper 63, or the stopper 63 is fixed in the middle of one cord.

The second operation cord 7 includes a cord member 71 formed in a string or a tape and connected at one end to the second pulley 52 to be wound around and unwound from, a gripping portion 72 provided at the other end of the cord member 71, and a stopper 73 fixed at a predetermined position between one end and the other end. The gripping portion 72 is a member for an operator to operate the second operation cord 7, in particular, to pull the second operation cord 7 downward so that the cord member 71 is unwound from the second pulley 52. The stopper 73 prevents the cord member 71 from being wound by the second pulley 52 to a predetermined amount or more. The structure of the cord member 71 and the stopper 73 may be such that the two different cords is connected within the stopper 73, or the stopper 73 is fixed in the middle of one cord.

(Schematic Configuration of Operating Device)

Figure 3:
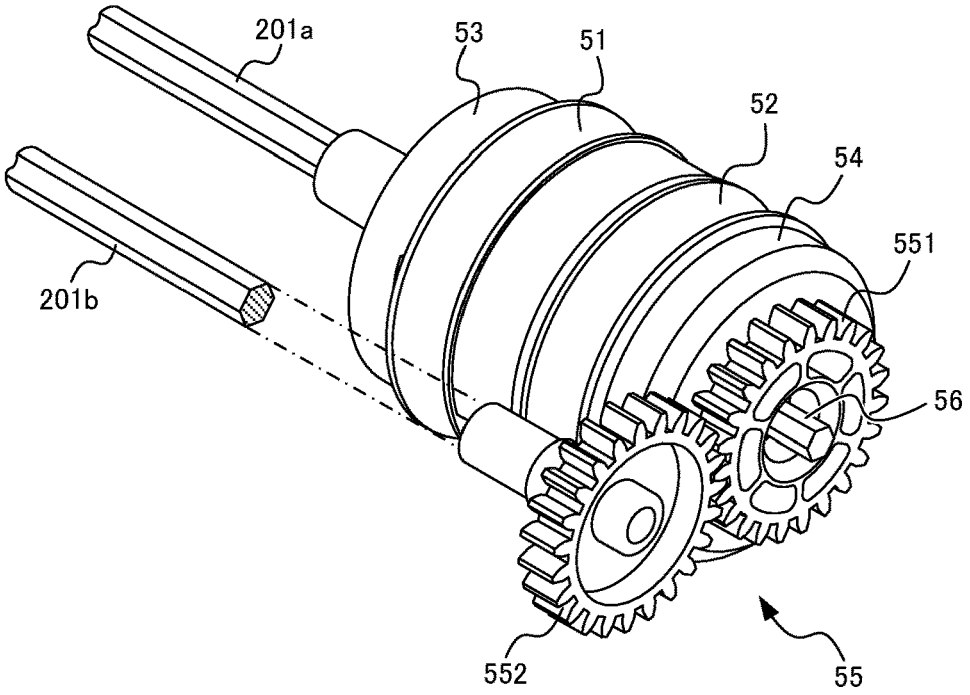
FIG. 3 is a perspective view showing a configuration of the shading device according to a first embodiment.
Figure 4:
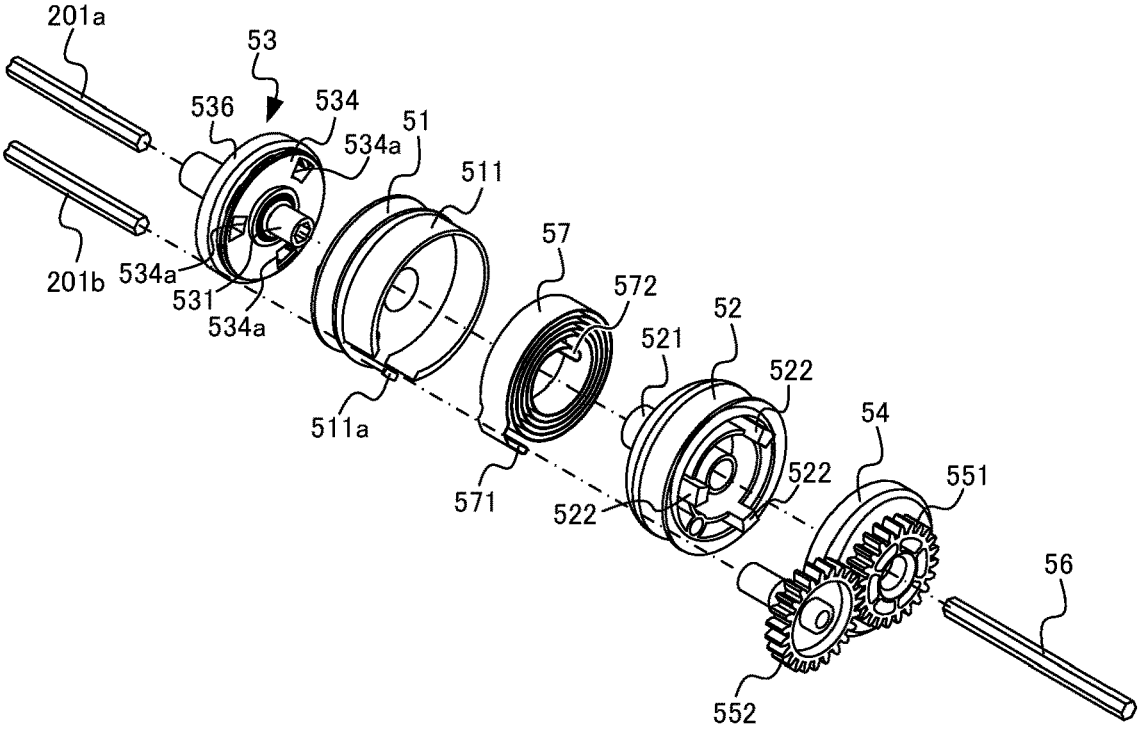
FIG. 4 is an exploded perspective view showing a configuration of an operating device according to the first embodiment.
Figure 5:
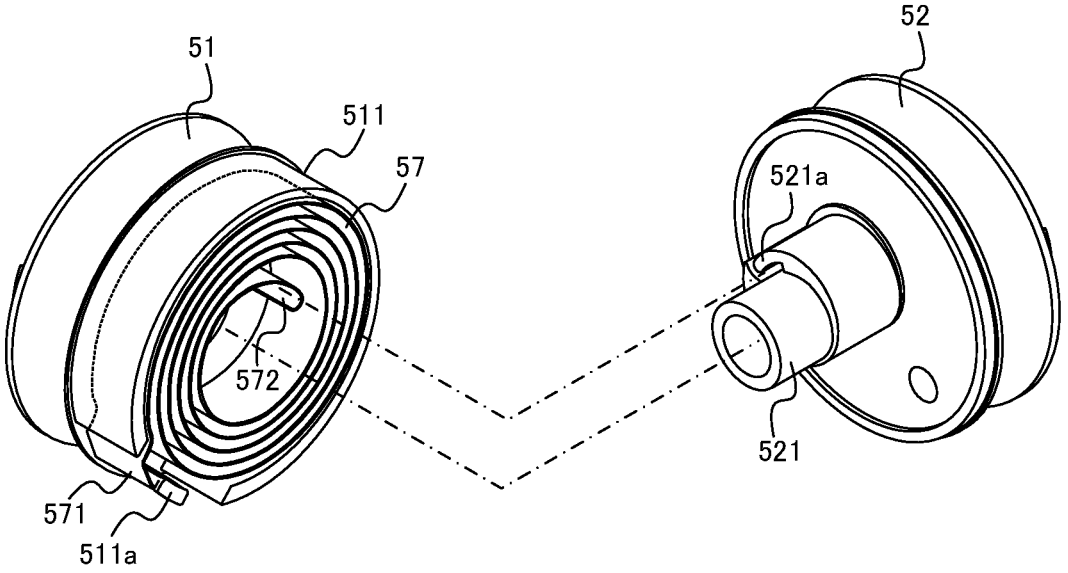
FIG. 5 is a perspective view showing a configuration of an urging member engaged with a first pulley and a second pulley.

A schematic configuration of the operating device according to this embodiment will be described. FIGS. 3 and 4 are a perspective view and an exploded perspective view, respectively, illustrating the configuration of the operating device according to this embodiment. FIG. 5 is a perspective view illustrating a configuration of an urging member engaged with the first pulley and the second pulley.

As illustrated in FIGS. 3 and 4, the operating device 5 includes an urging member 57 and a fixed shaft 56 in addition to the aforementioned first pulley 51, second pulley 52, first clutch mechanism 53, second clutch mechanism 54, and transmission mechanism 55 as the components contained in the space formed in the case 50, which is formed of three members 50*a* to 50*c*. The transmission mechanism 55 includes a first transmission gear 551 and a second transmission gear 552 that engages with the first transmission gear 551. The fixed shaft 56 is provided in the case 50 such that its shaft center is directed to the left and right and the position of its shaft center is substantially coincident with the first shaft center in the vertical and front-rear directions. The fixed shaft 56 supports the first pulley 51, the second pulley 52, and the first transmission gear 551 so as to be relatively rotated around its shaft center, and supports the respective portions of the first clutch mechanism 53 and the second clutch mechanism 54 so as not to be relatively rotated. The first pulley 51, the second pulley 52, the first clutch mechanism 53, the second clutch mechanism 54, and the transmission mechanism 55 are disposed in the order of the first clutch mechanism 53, the first pulley 51, the second pulley 52, the second clutch mechanism 54, and the transmission mechanism 55, from the inner side of the shading device in the left-right direction.

The first pulley 51 is a member that is connected to one end of the cord member 61 of the first operation cord 6 and is rotated about the first shaft center, thereby winding and unwinding the cord member 61, and has a surrounding portion 511 that surrounds the urging member 57 from radially outer side. As shown in FIG. 5, the surrounding portion 511 is formed as a circumferential wall extending to the second pulley 52 side in the first shaft center direction so as to surround the urging member 57, and a first locking portion 511*a* that locks one end of the urging member 57 is formed at a predetermined position in the circumferential direction.

The second pulley 52 is a member that is connected to one end of the cord member 71 of the second operation cord 7 and is rotated about the first shaft center, thereby winding and unwinding the cord member 71, and has a support shaft 521 that supports the first pulley 51 so as to be relatively rotatable about the first shaft center. As shown in FIG. 5, the support shaft 521 is formed in a cylindrical shape extending toward the first pulley 51 in the first shaft direction, and is insertable through the hole formed in the first pulley 51. The support shaft 521 also forms a second locking portion 521*a* on the second pulley 52 side in the first shaft direction to lock the other end of the urging member 57 in a predetermined circumferential position.

As shown in FIG. 5, the urging member 57 is a spiral-wound spring disposed between the first pulley 51 and the second pulley 52 to be wound around the support shaft 521 of the second pulley 52 as central axis in the space surrounded by the surrounding portion 511 of the first pulley 51. A first locked portion 571 is formed at one end of the urging member 57, specifically, at the radially outer end portion, and a second locked portion 572 is formed at the other end, specifically, at the radially inner end portion. The first locked portion 571 is formed by bending one end of the urging member 57.

The first locked portion 571 is locked to the first locking portion 511*a* formed in the surrounding portion 511 of the first pulley 51, whereby one end of the urging member 57 is fixed to the first pulley 51 so as not to be movable in the front-rear direction and the vertical direction. The second locked portion 572 is formed by bending the other end of the urging member 57 and is locked to the second locking portion 521*a* formed in the support shaft 521 of the second pulley 52, whereby the other end of the urging member 57 is fixed to the second pulley 52 so as not to be movable in the front-rear direction and the vertical direction.

The winding direction of the cord member 61 by the first pulley 51 and the winding direction of the cord member 71 by the second pulley 52 are opposite to each other. As such, the first pulley rotates in a first rotation direction when the cord member 61 is unwound, and the second pulley rotates in a second rotation direction opposite to the first rotation direction when the cord member 71 is unwound. The first clutch mechanism 53, which is provided adjacent to the first pulley 51 inwardly in the left-right direction, is configured to transmit the rotating force of the first pulley 51 in the first rotation direction to the first driving shaft 201*a* and to interrupt the transmission of the rotating force of the first pulley 51 in the second rotation direction to the first driving shaft 201*a*.

The first transmission gear 551 is supported by the fixed shaft 56 so as to be relatively rotatable and integrally rotates with a portion of the second clutch mechanism 54. The second transmission gear 552 is connected with the second driving shaft 201*b* so as to integrally rotate, and is provided to engage with the first transmission gear 551 and to transmit the rotational force of the first transmission gear 551 to the second driving shaft 201*b*.

The second clutch mechanism 54, which is provided adjacent to the second pulley 52 outwardly in the left-right direction, is configured to transmit the rotating force of the second pulley 52 in the second rotation direction to the first transmission gear 551, thereby transmitting the rotating force to the second driving shaft 201*b* through the second transmission gear 552, and to interrupt the transmission of the rotating force of the second pulley 52 in the first rotation direction to the second driving shaft 201*b*.

(Detailed Configuration of Operating Device)

Figure 6:
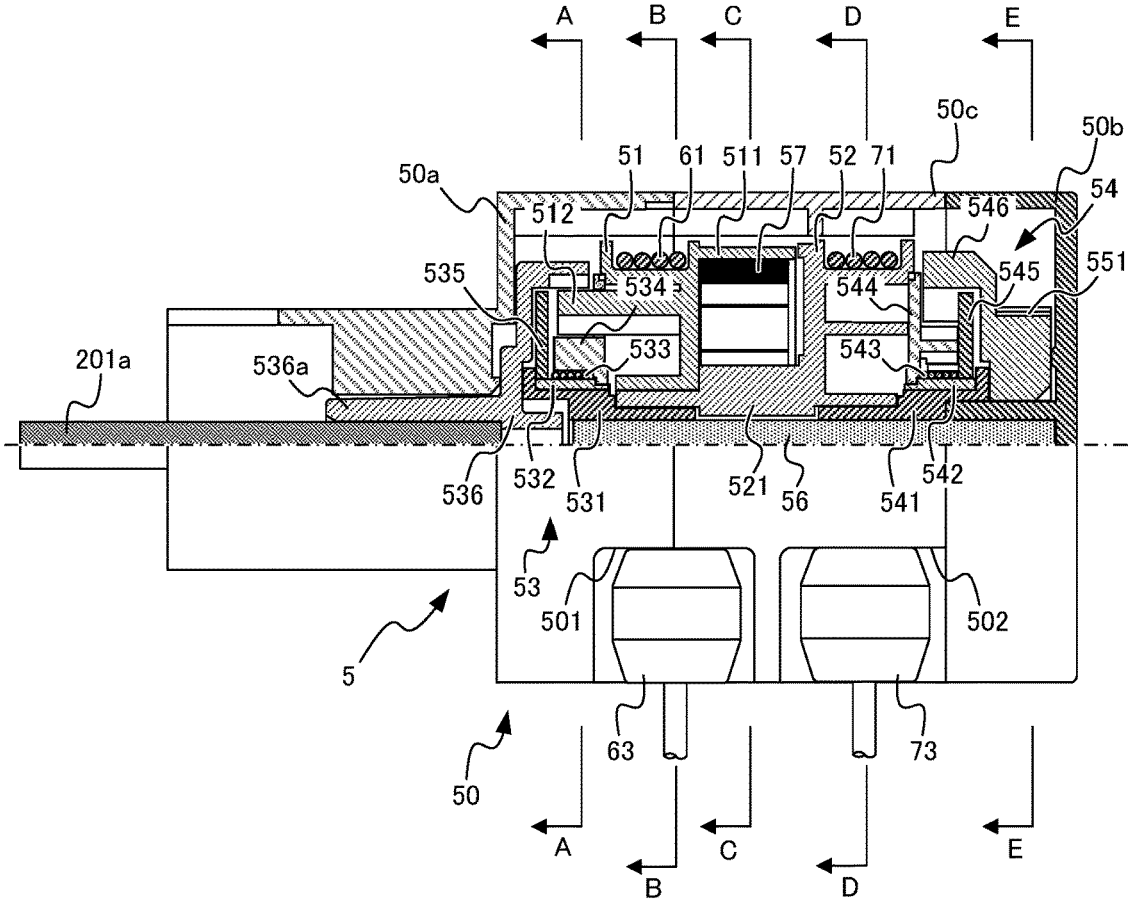
FIG. 6 is a front sectional view showing a configuration of the operating device according to the first embodiment.
Figure 7:
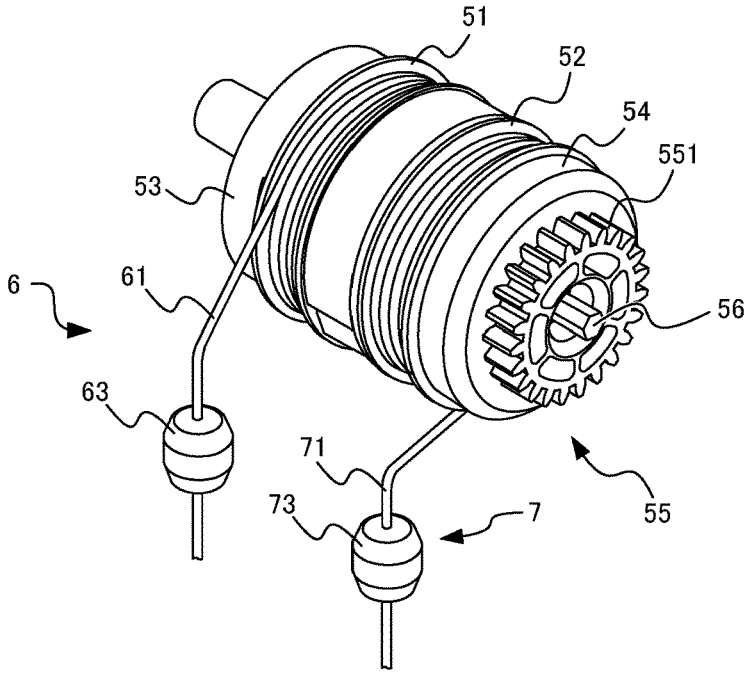
FIG. 7 is a perspective view showing the operating device in a non-operation state.

Detailed configuration of the operation device will be described. FIG. 6 is a front sectional view illustrating a configuration of the operating device according to the present embodiment. FIG. 7 is a perspective view illustrating the operating device in a non-operation state. FIGS. 8, 9, 10, 11 and 12 are respectively A-A, B-B, C-C, D-D, and E-E cross-sectional views of FIG. 6 in a non-operation state. In FIG. 6, only a part of the operation device upward from the first shaft center is shown as a cross-sectional plane that passes through the first shaft center and extends in the vertical direction and the left-right direction. In FIG. 7, the second transmission gear is shown transparent. The non-operation state indicates that neither the first operation cord nor the second operation cord is operated.

First, restricting the first operation cord 6 and the second operation cord 7 from being wound up over a predetermined amount will be described in detail. As shown in FIG. 6, at the front lower end of the case 50, a first winding restriction unit 501 is formed below the first pulley 51 so as to correspond to the first pulley 51 and a second winding restriction unit 502 is formed below the second pulley 52 so as to correspond to the second pulley 52. The first winding restriction unit 501 and the second winding restriction unit 502 are formed at different positions in the left-right direction. In this embodiment, the first winding restriction unit 501 is formed inward of the left-right direction and the second winding restriction unit 502 is formed outward of the left-right direction according to the arrangement of the first pulley 51 and the second pulley 52.

As shown in FIGS. 6, 9, 10, and 11, the first winding restriction unit 501 and the second winding restriction unit 502 are respectively formed as a housing space for accommodating the stopper 63 of the first operation cord 6 and a housing space for accommodating the stopper 73 of the second operation cord 7, and these accommodation spaces are continuously formed on two surfaces in the front and the bottom so that the front and bottom surfaces are opened.

An insertion hole 501*a* (see FIG. 9) in which the cord member 61 is insertable is formed at the ceiling wall of the first winding restriction unit 501. The insertion hole 501*a* has a diameter which is larger than the cord member 61 and in which the stopper 63 is not insertable. Similarly, an insertion hole 502*a* (see FIG. 11) in which the cord member 71 is insertable is formed at the ceiling wall of the second winding restriction unit 502. The insertion hole 502*a* has a diameter which is larger than the cord member 71 and in which the stopper 73 is not insertable. As shown in FIG. 7, the first winding restriction unit 501 and the stopper 63 prevent the first pulley 51 from winding up the cord member 61 by a predetermined amount or more. Similarly, the second winding restriction unit 502 and the stopper 73 prevent the second pulley 52 from winding up the cord member 71 by a predetermined amount or more.

Figure 8:
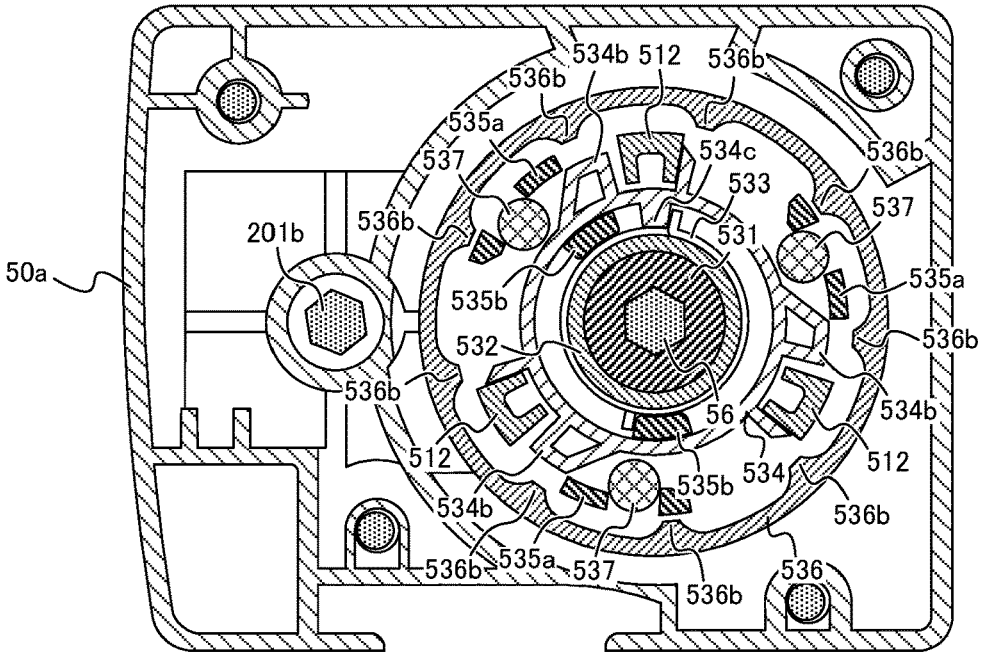
FIG. 8 is a cross-sectional view taken along line A-A of FIG. 6 in a non-operation state.
Figure 9:
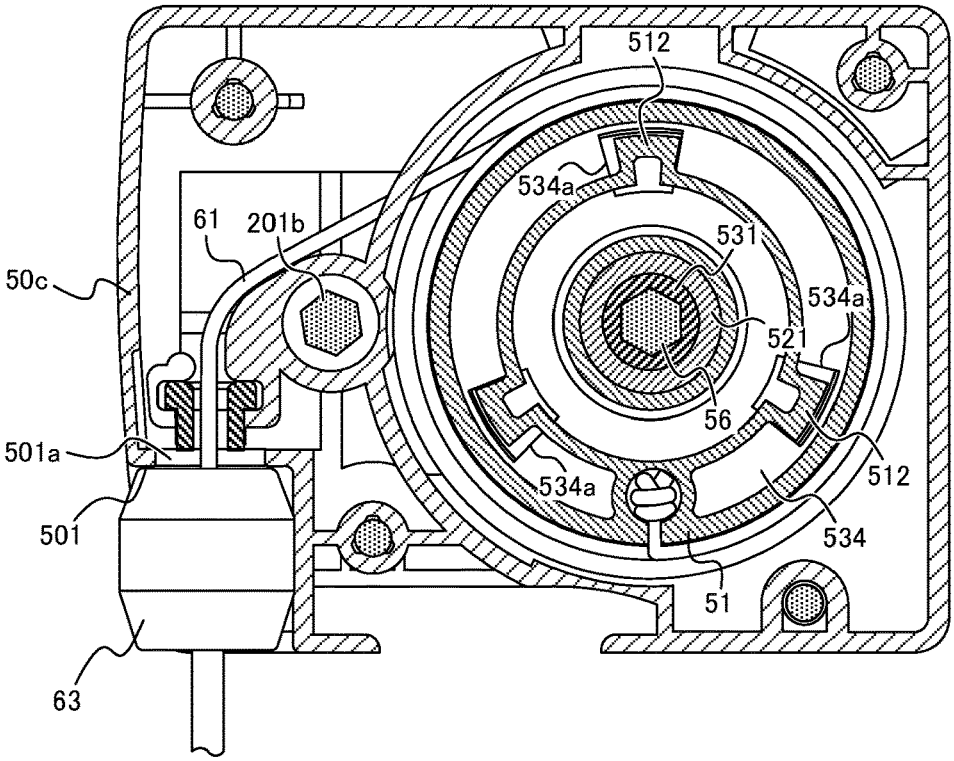
FIG. 9 is a cross-sectional view taken along line B-B of FIG. 6 in a non-operation state.

Next, the structures of the first clutch mechanism 53 and the second clutch mechanism 54 will be described in detail. As shown in FIGS. 6, 8, and 9, the first clutch mechanism 53 includes a relay shaft 531, a clutch drum 532, a clutch spring 533, a cam drive 534, a guide washer 535, an interlocking member 536, and three clutch pins 537. Similarly, as shown in FIG. 6, the second clutch mechanism 54 includes a relay shaft 541, a clutch drum 542, a clutch spring 543, a cam drive 544, a guide washer 545, an interlocking member 546, and three clutch pins 547. The elements of the second clutch mechanism 54 respectively correspond to the same-named elements of the first clutch mechanism 53, and thus the elements of the first clutch mechanism 53 are described in detail for explaining the first clutch mechanism 53 and the second clutch mechanism 54, and the elements of the second clutch mechanism 54 are described only about the differences from the first clutch mechanism 53.

The relay shaft 531 is supported by the fixed shaft 56 so as not to relatively rotate and supports the clutch drum 532 to prevent relative rotation. The clutch drum 532 is formed in a hollow cylinder and is supported by the relay shaft 531 fitted into the hollow portion thereof so as not to relatively rotate. The clutch spring 533 is a linear elastic member that is wound around the clutch drum 532 to a degree that is rotated relative to the clutch drum 532 when loosened, and both ends of the clutch spring 533 are bent so as to face radially outward (see FIG. 8).

The cam drive 534 is shaped to have a substantially hollow cylindrical portion which is rotatably supported by the clutch drum 532 and a disc-like side portion which extends radially outward throughout the circumference to form the side surface of the first clutch mechanism 53 on the first pulley 51 side.

A side surface of the cam drive 534 has three openings 534*a* (see FIGS. 4 and 9) formed at equidistant intervals in the circumferential direction, and three projections 512 provided in the first pulley 51 are inserted in the openings 534*a*. Three projections 512 are formed on the side surface of the first pulley 51 on the first clutch mechanism 53 side at equidistant intervals in the circumferential direction so as to respectively correspond to the three openings 534*a*, each projecting toward the first clutch mechanism 53. Similarly, the second pulley 52 has three projections 522 (see FIG. 4) each formed to project toward the second clutch mechanism 54 so as to be inserted into three openings (not shown) provided in the cam drive 544.

The cylindrical portion of the cam drive 534 has three cams 534*b* formed at equidistant intervals on the circumferential wall and has one engagement portion 534*c* at the internal wall. Each of the three cams 534*b* projects radially outward as a whole and includes a cam surface formed on one side in the circumferential direction. The cam surface is formed as an inclined surface that slides the clutch pin 537 radially outward when the cam drive 534 is rotated relative to the guide washer 535 on the side on which the cam surface is formed. The engagement portion 534*c* projects radially inward to be engaged with the guide washer 535. The cam drive 534 engages with the three projections 512, thereby rotating in accordance with the first pulley 51 in any direction the first pulley 51 rotates.

The guide washer 535 is generally formed in a disc having a hole formed at the center, in which the clutch drum 532 is inserted in a relatively rotatable manner. The guide washer 535 has three guide portions 535*a*, which guide the clutch pins 537 to radially appear/disappear and are formed at equidistant intervals in the circumferential direction, and also has two engagement portions 535*b* formed apart from each other in the circumferential direction. One of the engagement portions 535*b* is formed in contact with the engagement portion 534*c* of the cam drive 534, and when the cam drive 534 is rotated to move the clutch pin 537 radially outward and the engagement portions 535*b* is pressed by the engagement portion 534*c* in the circumferential direction, the cam drive 534 and the guide washer 535 thereby integrally rotate.

The interlocking member 536 includes a shaft portion 536*a* supported by the first driving shaft 201*a* so as not to relatively rotate, and a plurality of engaging portions 536*b* provided at intervals in the circumferential direction and each projecting radially inward so as to engage with the clutch pins 537. The interlocking member 546 is different from the interlocking member 536 in that the interlocking member 546 does not have a shaft portion and is integrally formed with the first transmission gear 551 so as to be rotatably supported by the fixed shaft 56.

The clutch pin 537 is formed in a cylindrical shape with the bottom surfaces on both sides facing in the left-right direction, and is sandwiched between the cam drive 534 and the guide washer 535 from both sides in the left-right direction. When the clutch pin 537 is guided by the guide portions 535*a* of the guide washer 535 and is moved radially outward by the cam 534*b* of the cam drive 534, the clutch pin 537 is in contact with the engagement portion 536*b* of the interlocking member 536. At this time, the guide washer 535 and the interlocking member 536 are engaged through the clutch pin 537 so as to rotate integrally.

Figure 10:
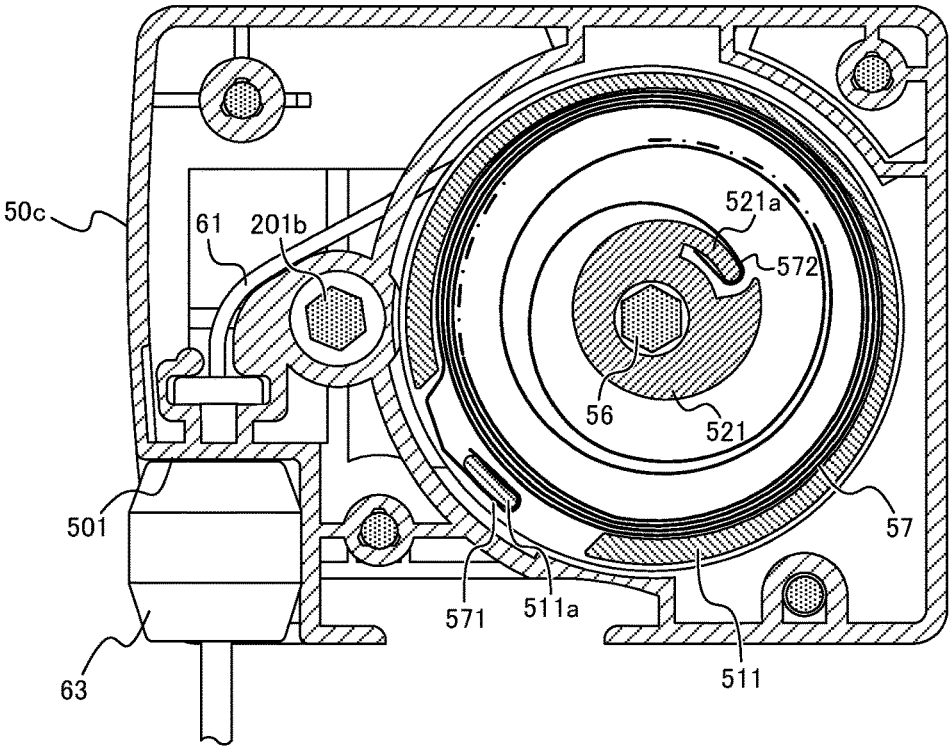
FIG. 10 is a cross-sectional view taken along line C-C of FIG. 6 in a non-operation state.
Figure 11:
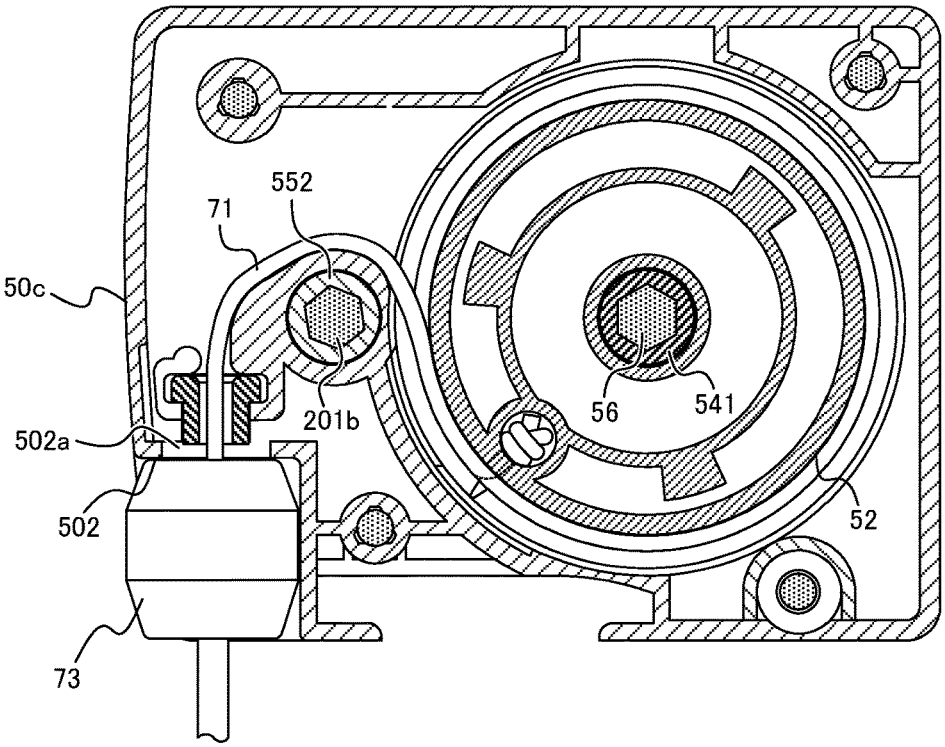
FIG. 11 is a cross-sectional view taken along line D-D of FIG. 6 in a non-operation state.

Next, the urging member 57 will be described in detail. As shown in FIG. 10, the first locked portion 571 formed at the radially outer end of the urging member 57 is locked to the first locking portion 511*a* formed on the first pulley 51, and the second locked portion 572 formed at the radially inner end of the urging member 57 is locked to the second locking portion 521*a* formed on the second pulley 52. As described above, the winding direction of the first operation cord 6 by the first pulley 51 is opposite to the winding direction of the second operation cord 7 by the second pulley 52, and the stopper 63 and the stopper 73 prevent the first operation cord 6 and the second operation cord 7 from being wound by a predetermined amount or more. With this configuration, when one of the first pulley 51 and the second pulley 52 is rotated by operating the first operation cord 6 or the second operation cord 7, the other pulley is not rotated. Accordingly, one of the first locking portion 511*a* and the second locking portion 521*a* is moved in the circumferential direction and the other is not moved in the circumferential direction, and thus the urging member 57 is wound by operating either the first operation cord 6 or the second operation cord 7.

The urging member 57 in a non-operation state is housed between the first pulley 51 and the second pulley 52 without being wound around the support shaft 521 of the second pulley 52, where the surrounding portion 511 prevents the urging member 57 from spreading radially outward. The surrounding portion 511 may be formed in a member other than the first pulley 51, for example, the second pulley 52 or the case 50. However, in this case as well, the first locking portion 511*a* needs to be formed in the first pulley 51.

Figure 12:
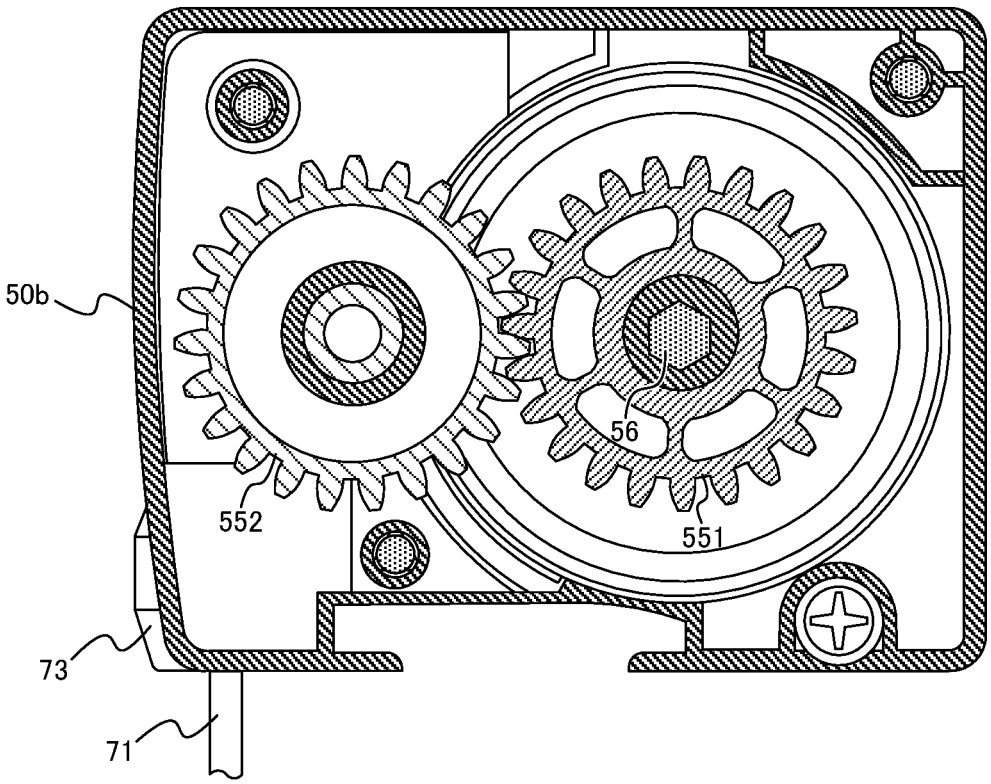
FIG. 12 is a cross-sectional view taken along line E-E of FIG. 6 in a non-operation state.

Next, the transmission mechanism 55 will be described in detail. As shown in FIG. 12, when the rotational force of the first transmission gear 551 is transmitted to the second transmission gear 552, the rotational direction of the first transmission gear 551 and the rotational direction of the second transmission gear 552 are opposite to each other. As such, even if the winding directions of the first pulley 51 and the second pulley 52 are opposite to each other as described above, the rotational direction of the first driving shaft 201*a* by the first pulley 51 and the rotational direction of the second driving shaft 201*b* by the second pulley 52 are the same direction.

(Operation by First Operation Cord)

Figure 13:
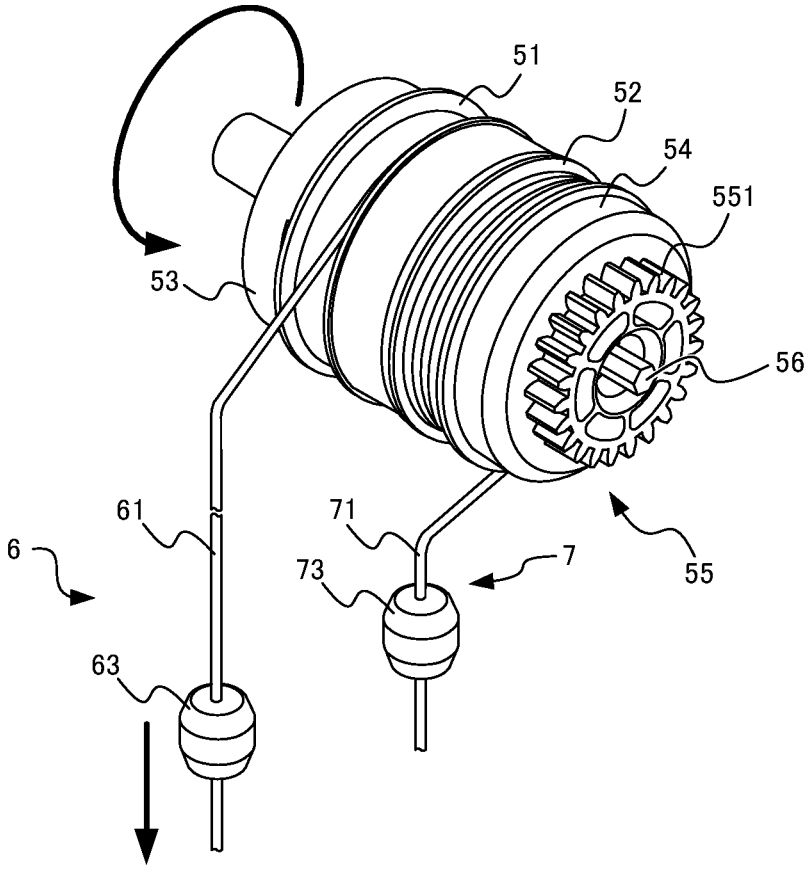
FIG. 13 is a perspective view of the operation device in which a first operation cord is operated.
Figure 14:
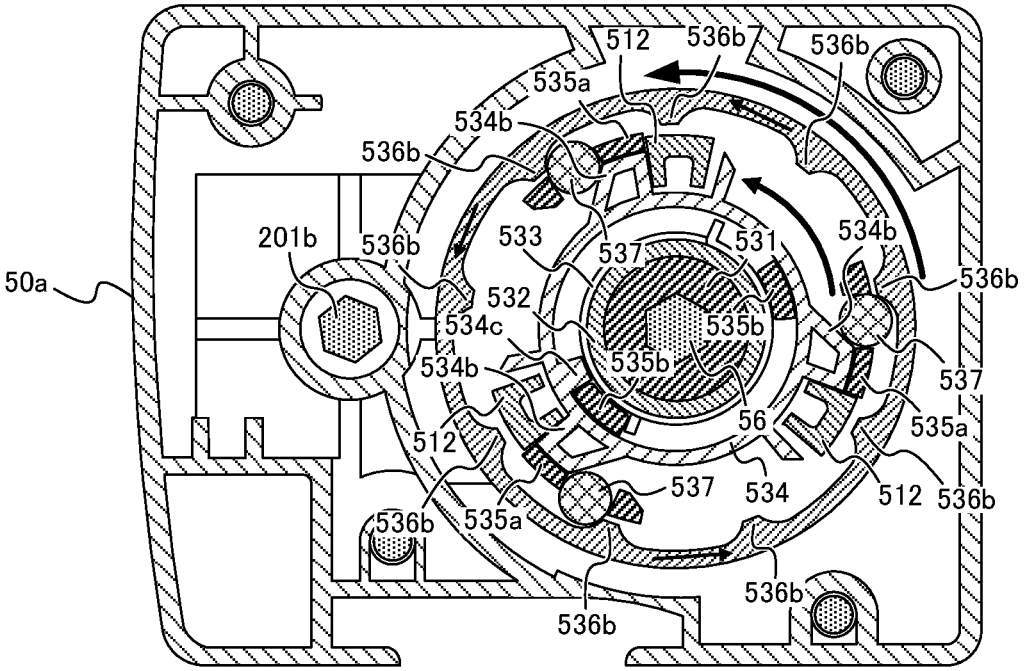
FIG. 14 is a cross-sectional view taken along line A-A of FIG. 6 in a state where the first operation cord is operated.
Figure 15:
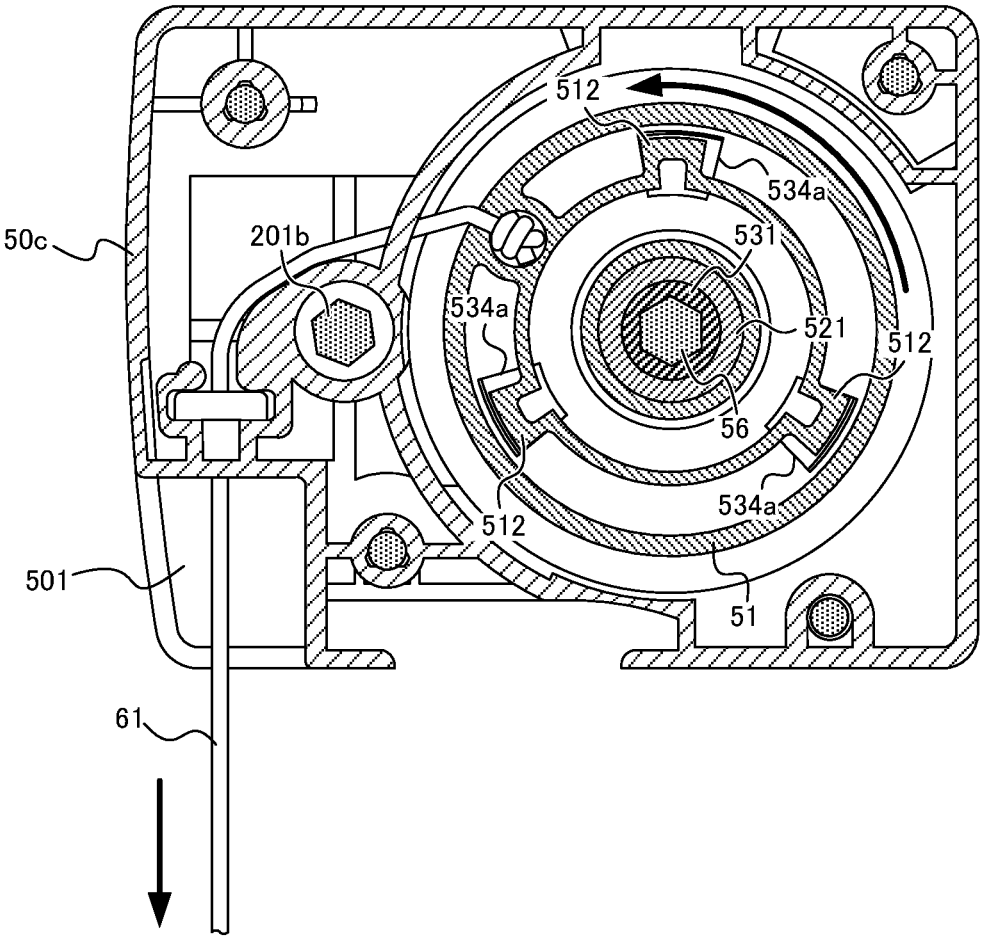
FIG. 15 is a cross-sectional view taken along line B-B of FIG. 6 in a state where the first operation cord is operated.
Figure 16:
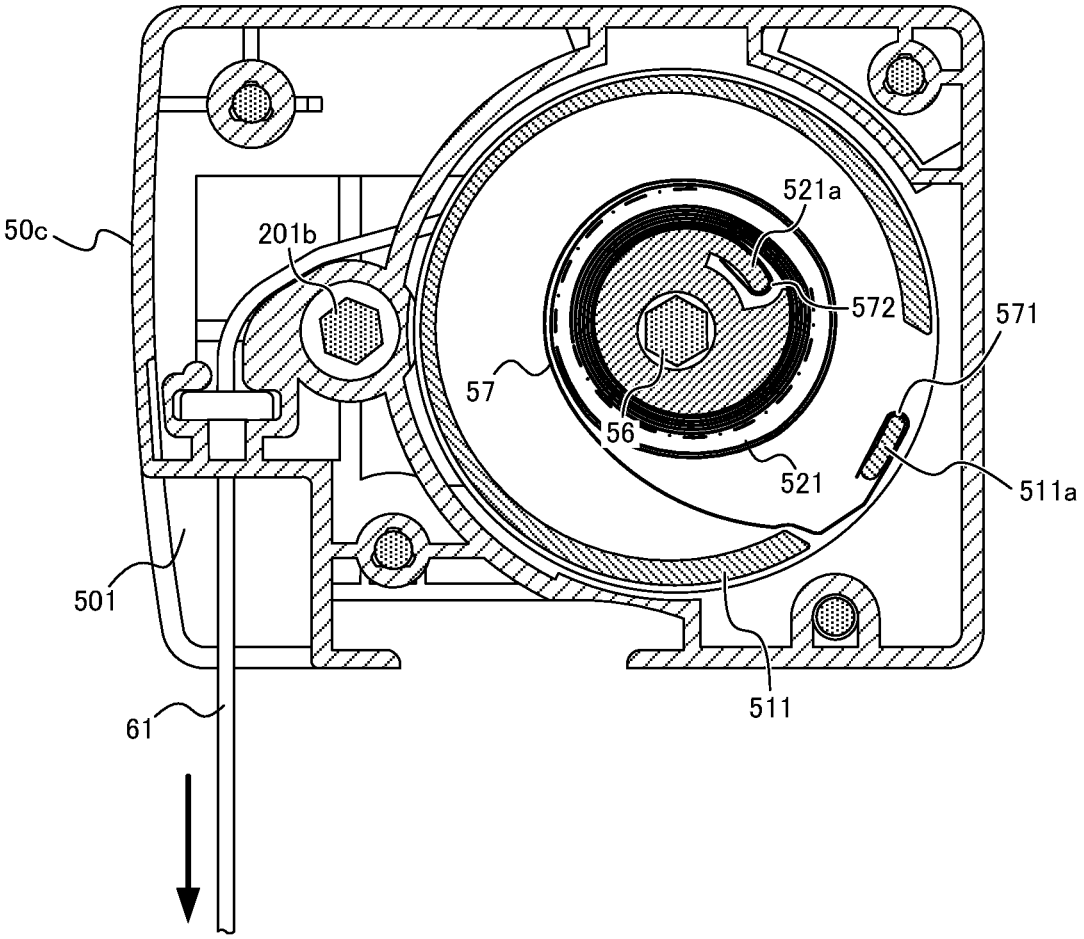
FIG. 16 is a cross-sectional view taken along line C-C of FIG. 6 in a state where the first operation cord is operated.
Figure 17:
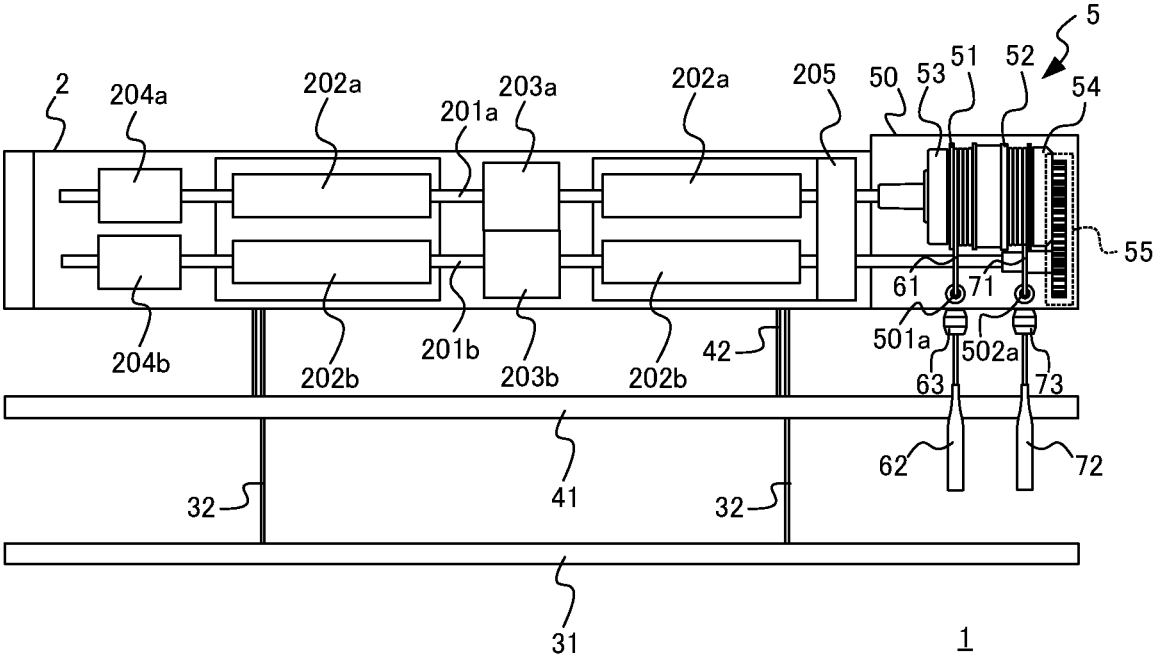
FIG. 17 is a schematic diagram illustrating the shading device with a bottom rail and an intermediate bar moved to the lower limit.
Figure 18:
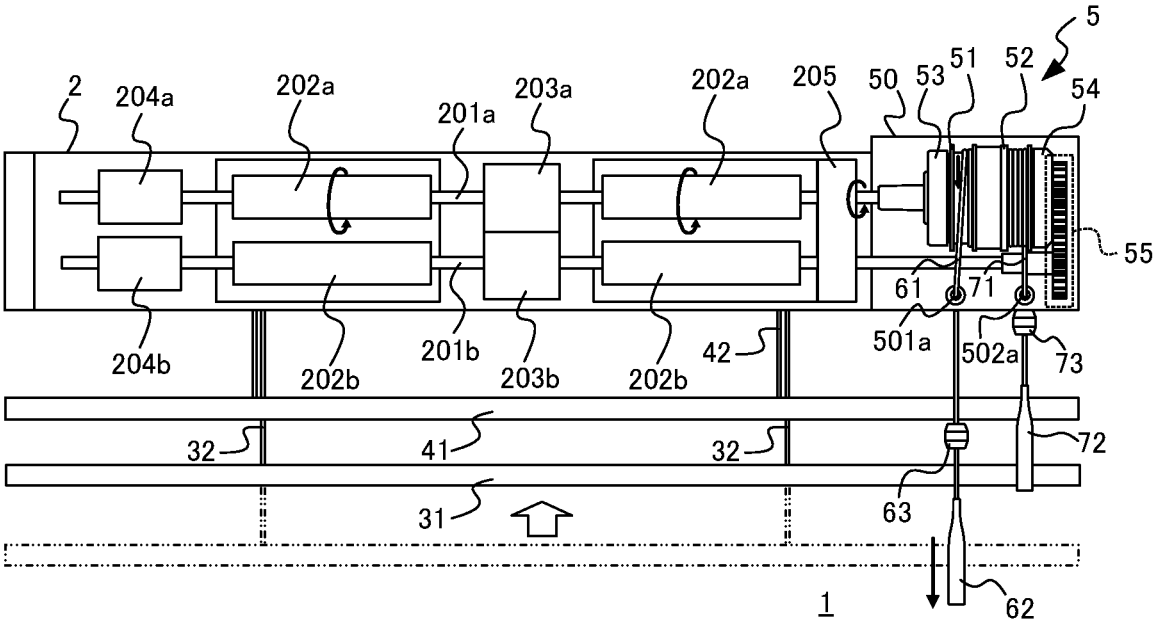
FIG. 18 is a schematic diagram illustrating the shading device in a state in which a continuous pulling operation is performed for the first operation cord.
Figure 19:
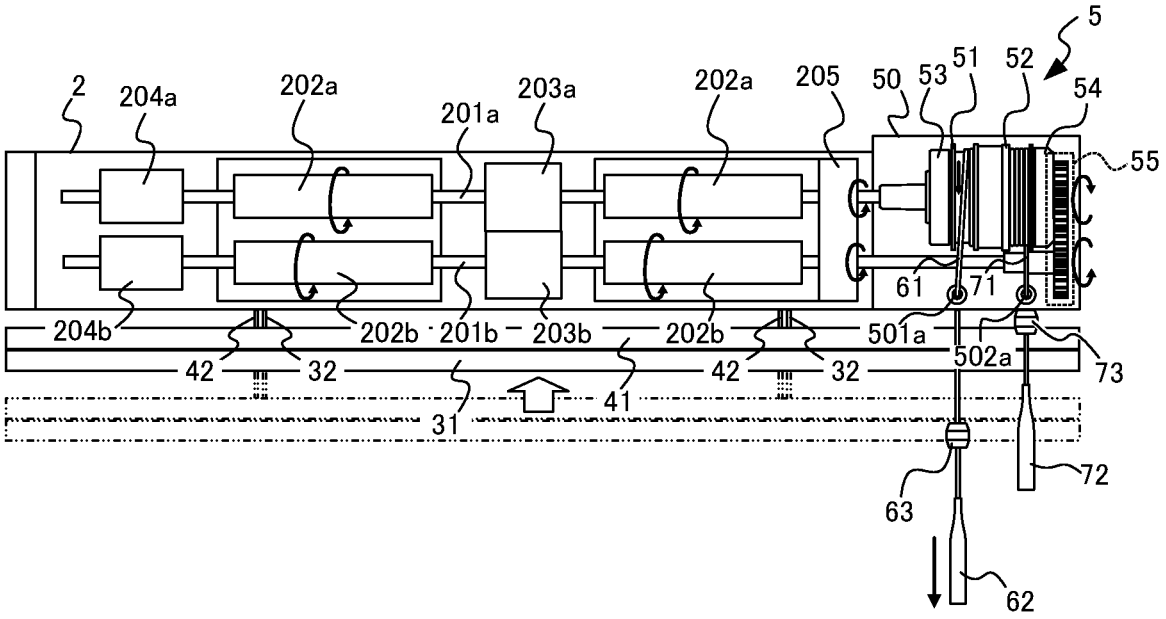
FIG. 19 is a schematic diagram illustrating the shading device when an interlocking gear is operated.
Figure 20:
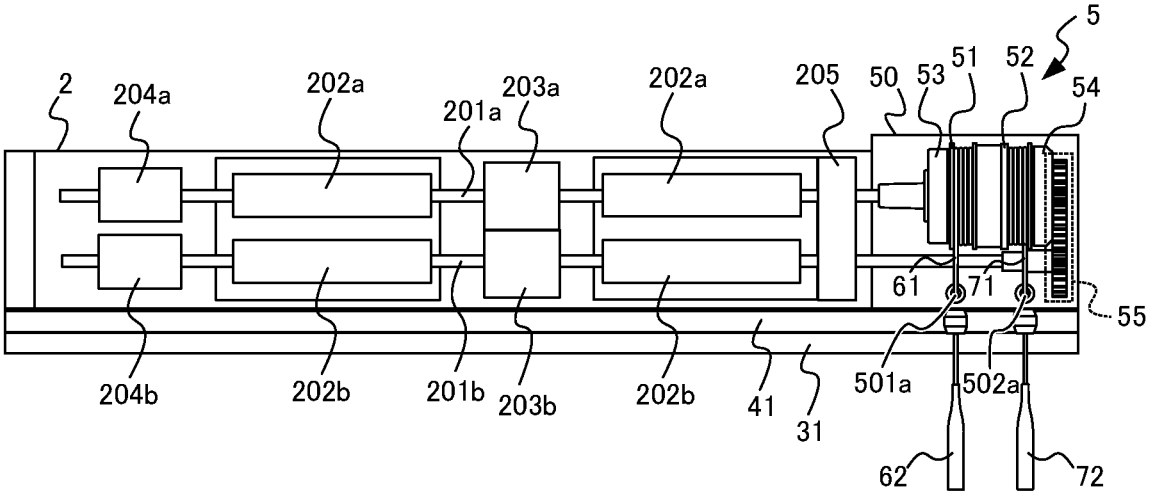
FIG. 20 is a schematic diagram illustrating the shading device with the bottom rail and the intermediate bar moved to the upper limit.
Figure 21:
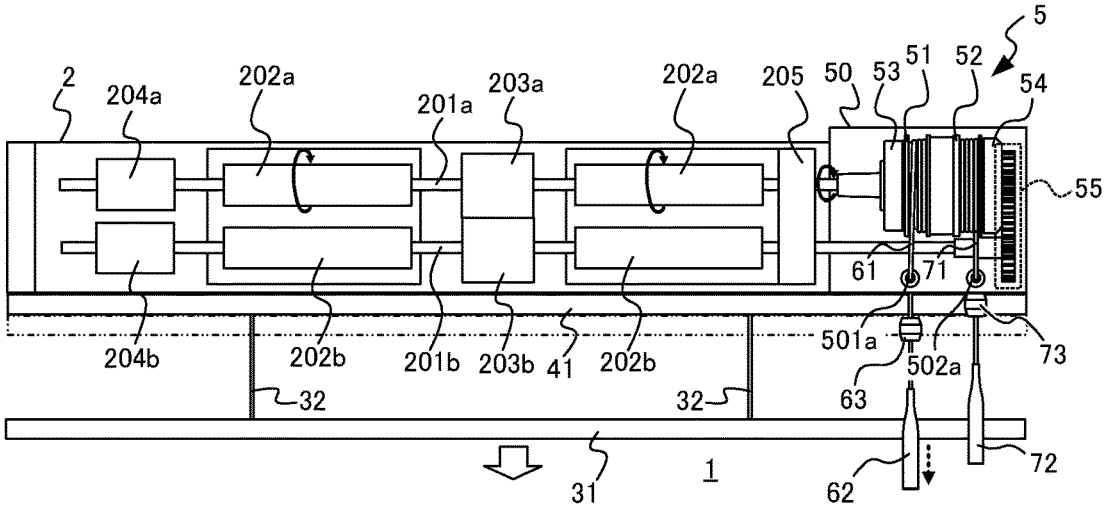
FIG. 21 is a schematic diagram illustrating the shading device when a release operation is performed.

The operation of the operation device and the shading device by the first operation cord will be described. FIG. 13 is a perspective view of the operation device in which the first operation cord is operated. FIGS. 14, 15, and 16 are cross-sectional views taken along line A-A, line B-B, and line C-C of FIG. 6, respectively, in a state where the first operation cord is operated. FIG. 17 is a schematic diagram illustrating the shading device with the bottom rail and the intermediate bar moved to the lower limit. FIG. 18 is a schematic diagram illustrating the shading device in a state in which a continuous pulling operation is performed for the first operation cord. FIG. 19 is a schematic diagram illustrating the shading device when the interlocking gear is operated. FIG. 20 is a schematic diagram illustrating the shading device with the bottom rail and the intermediate bar moved to the upper limit. FIG. 21 is a schematic diagram illustrating the shading device when a release operation is performed.

As shown in FIG. 13, when the first operation cord 6 is pulled down by an operator, as shown in FIG. 15, the first pulley 51 rotates in a first unwinding direction, which is an unwinding direction of the first operation cord 6, and, as shown in FIG. 14, the rotation of the first pulley 51 is transmitted to the interlocking member 536 of the first clutch mechanism 53. At this time, winding of the second operation cord 7 is restricted, which also restricts the rotation of the second pulley 52. Accordingly, as shown in FIG. 16, the first locking portion 511*a* formed in the first pulley 51 rotates relative to the second locking portion 521*a* formed in the second pulley 52 so as to reduce the diameter of the urging member 57. In this manner, urging force is accumulated in the urging member 57 for the first pulley 51 to wind up the first operation cord 6 that has been unwound from the first pulley 51. When the operator releases the first operation cord 6 and the accumulated urging force is thereby released, the first operation cord 6 that has been pulled is wound by the first pulley 51, and the first driving shaft 201*a* is rotated each time the first operation cord 6 is pulled. This serves to reduce a length to pull the first operation cord 6 required for winding up the lifting/lowering cord 32 in a single pulling operation.

As shown in FIG. 17, in a state where the bottom rail 31 of the shading device 1 is moved to the lower limit, if the first operation cord 6 is pulled continuously and the first driving shaft 201*a* continues to rotate in accordance with the rotation of the interlocking member 536 as described above, as shown in FIG. 18, the bottom rail 31 coupled to the lifting/lowering cord 32 is moved upward by the first winding drum 202*a* winding up the lifting/lowering cord 32. Further, when the first driving shaft 201*a* is rotated in the first winding direction to the extent that the bottom rail 31 pushes up the intermediate bar 41 from below, the interlocking gear 205 operates in response to the detection of looseness of the light control cord 42, and, as shown in FIG. 19, the second driving shaft 201*b* follows the first driving shaft 201*a* and rotates in the same direction as the first driving shaft 201*a*, and the bottom rail 31 and the intermediate bar 41 are moved upward. Eventually, as shown in FIG. 20, the bottom rail 31 and the intermediate bar 41 are moved upward to the upper limit.

When the operator releases the first operation cord 6 in a state where the first operation cord 6 is pulled by a predetermined amount or less, the urging member 57 rotates the first pulley 51 in the first winding direction in which the first operation cord 6 is wound, and accordingly, the engagement of the guide washer 535 and the interlocking member 536 through the clutch pin 537 is released. As shown in FIG. 21, the bottom rail 31 thus moves downward due to its own weight.

(Operation by Second Operation Cord)

Figure 22:
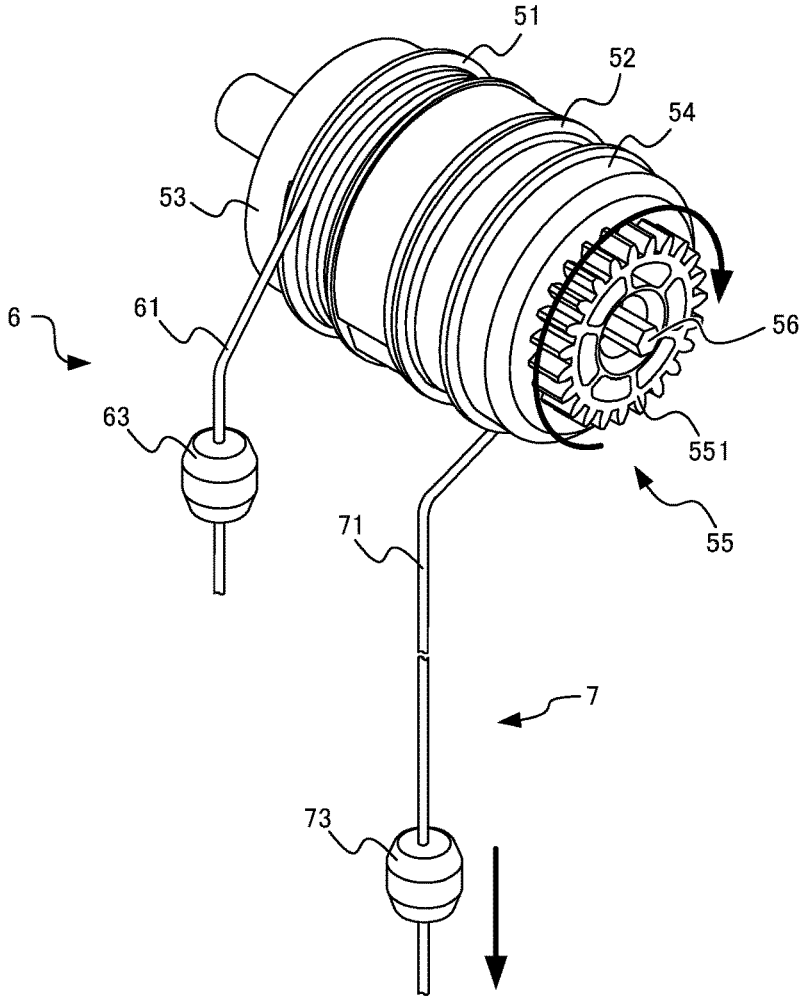
FIG. 22 is a perspective view of the operation device in which a second operation cord is operated.
Figure 23:
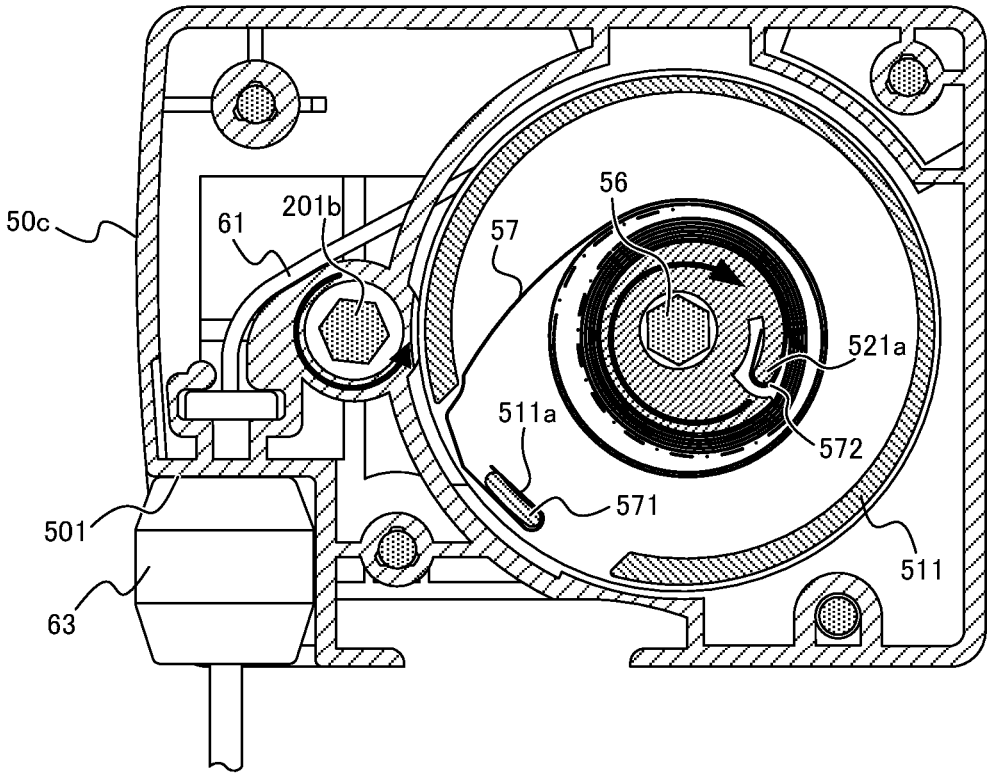
FIG. 23 is a cross-sectional view taken along line C-C of FIG. 6 in a state where the second operation cord is operated.
Figure 24:
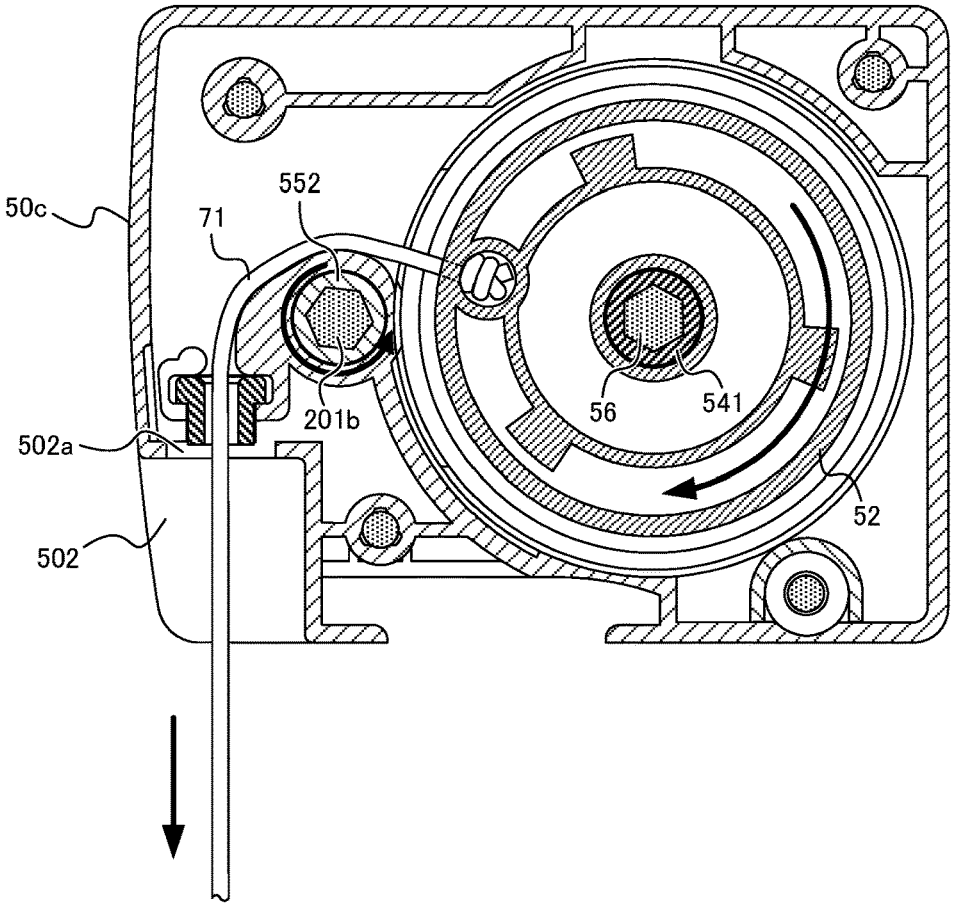
FIG. 24 is a cross-sectional view taken along line D-D of FIG. 6 in a state where the second operation cord is operated.
Figure 25:
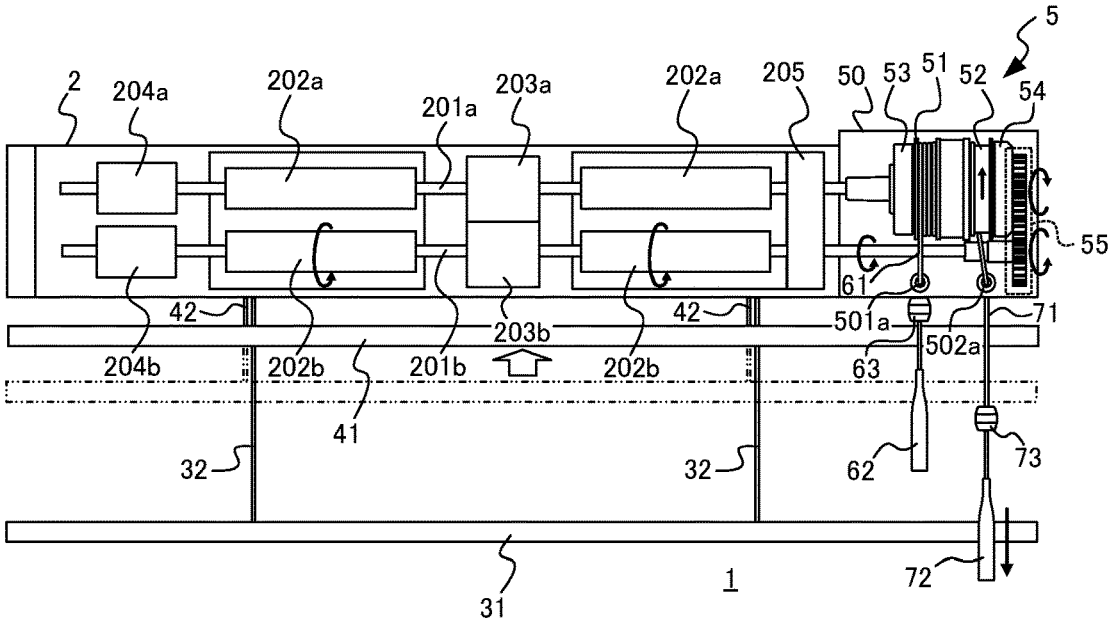
FIG. 25 is a schematic diagram illustrating the shading device in a state in which a continuous pulling operation is performed for the second operation cord.

The operation of the operation device and the shading device by the second operation cord will be described. FIG. 22 is a perspective view of the operation device in which the second operation cord is operated. FIGS. 23 and 24 are cross-sectional views taken along line C-C and line D-D of FIG. 6, respectively, in a state where the second operation cord is operated. FIG. 25 is a schematic diagram illustrating the shading device in a state in which a continuous pulling operation is performed for the second operation cord.

As shown in FIG. 22, when the second operation cord 7 is pulled down by an operator, as shown in FIG. 24, the second pulley 52 rotates in a second unwinding direction, which is a unwinding direction of the second operation cord 7, and the rotation of the second pulley 52 is transmitted to the interlocking member 546 of the second clutch mechanism 54. The rotation of the interlocking member 546 is then transmitted to the second driving shaft 201*b* through the transmission mechanism 55. At this time, winding of the first operation cord 6 is restricted, which also restricts the rotation of the first pulley 51. Accordingly, as shown in FIG. 23, the second locking portion 521*a* formed in the second pulley 52 rotates relative to the first locking portion 511*a* formed in the first pulley 51 so as to reduce the diameter of the urging member 57. In this manner, urging force is accumulated in the urging member 57 for the second pulley 52 to wind up the second operation cord 7 that has been unwound from the second pulley 52. When the operator releases the second operation cord 7 and the accumulated urging force is released, the second operation cord 7 that has been pulled is wound by the second pulley 52, and the second driving shaft 201*b* is rotated each time the second operation cord 7 is pulled. This serves to reduce a length to pull the second operation cord 7 required for winding up the light control cord 42 in a single pulling operation.

As shown in FIG. 17, in a state where the bottom rail 31 and the intermediate bar 41 of the shading device 1 are moved to the lower limit, if the second operation cord 7 is pulled continuously and the second driving shaft 201*b* continues to rotate in accordance with the rotation of the interlocking member 546 as described above, as shown in FIG. 25, the intermediate bar 41 coupled to the light control cord 42 is moved upward by the second winding drum 202*b* winding up the light control cord 42.

According to the operation device 5 of the present embodiment, the first pulley 51 and the second pulley 52 are disposed in the left-right direction, and thus, the hanging position of the first operation cord 6 and the hanging position of the second operation cord 7 can be different in the left-right direction, and the two types of operation cords can be lowered in a state easy to discriminate. Further, the urging member 57 is disposed between the first pulley 51 and the second pulley 52, and is shared in the winding of the first operation cord 6 and the second operation cord 7. This serves to reduce the number of components and achieve space saving.

Second Embodiment

Figure 26:
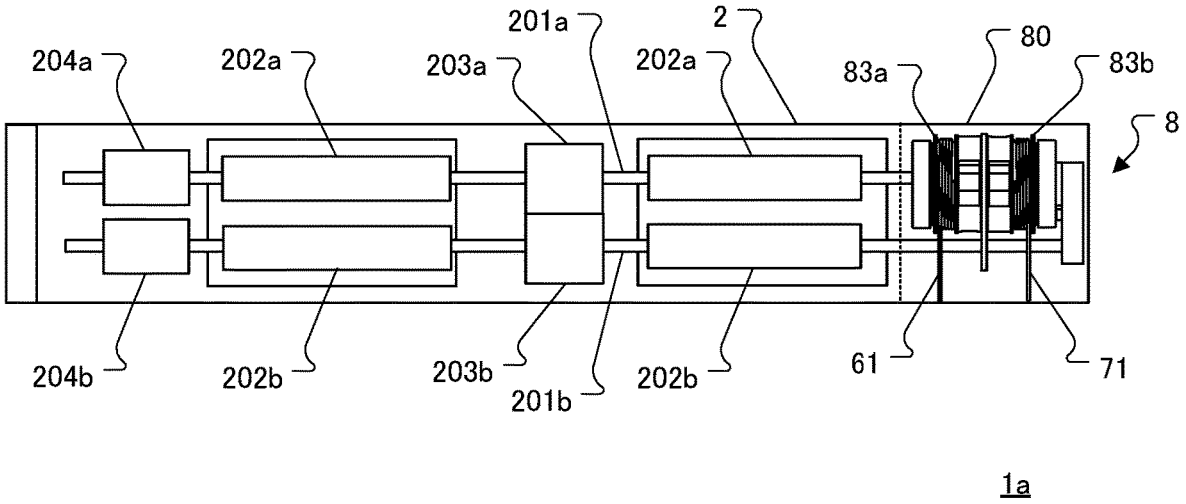
FIG. 26 is a schematic plan perspective view of the shading device according to the second embodiment.
Figure 27:
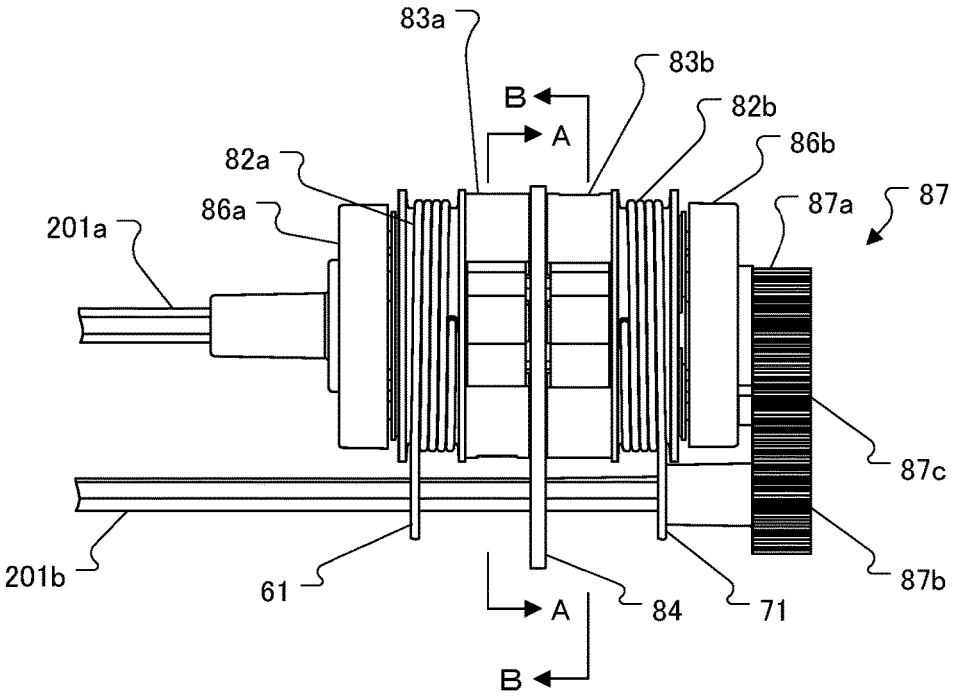
FIG. 27 is a plan view showing a configuration of the shading device according to the second embodiment.
Figure 28:
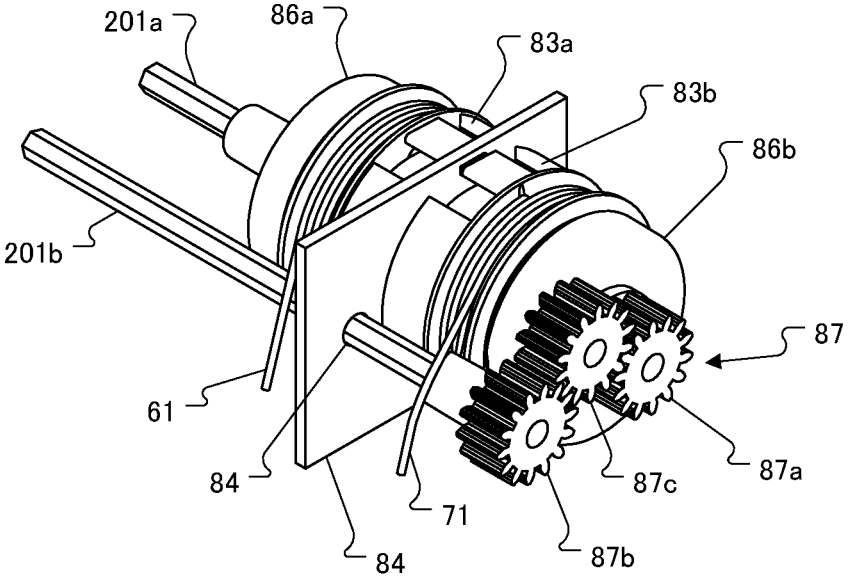
FIG. 28 is a perspective view showing a configuration of the shading device according to the second embodiment.
Figure 29:
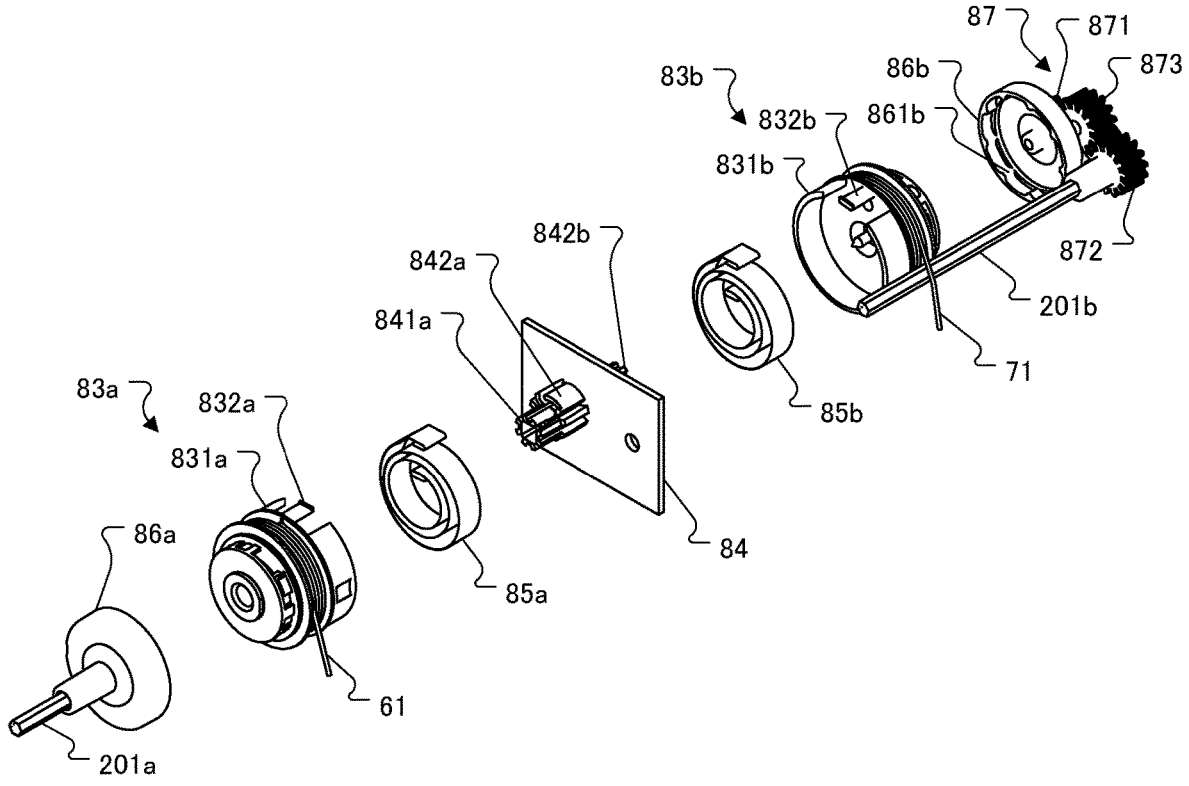
FIG. 29 is an exploded perspective view of the operation device according to the second embodiment viewed from a first interlocking member.
Figure 30:
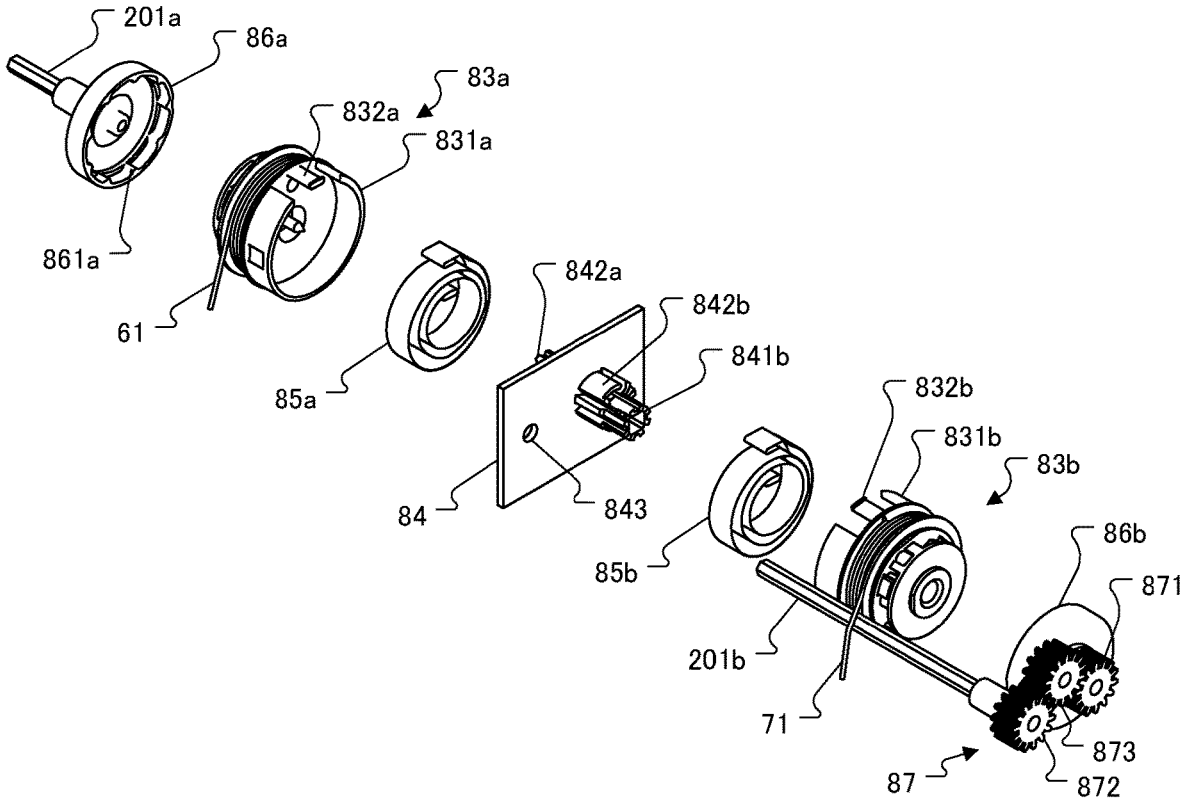
FIG. 30 is an exploded perspective view of the operation device according to the second embodiment viewed from a second interlocking member.
Figure 31A:
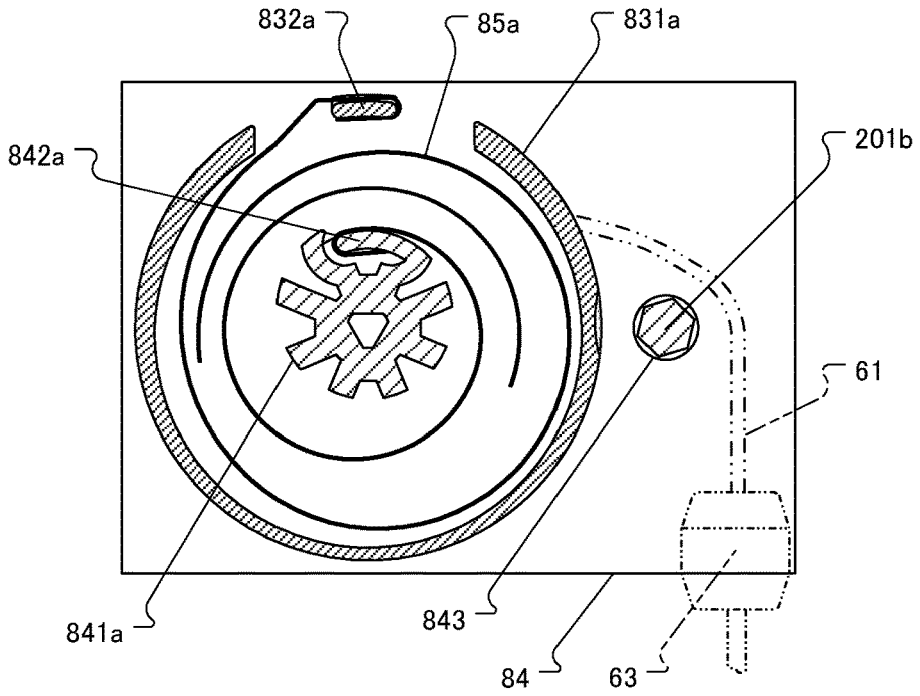
FIG. 31(*a*) is a cross-sectional view taken along line A-A of FIG. 27 showing a non-operation state of the first operation cord.
Figure 31B:
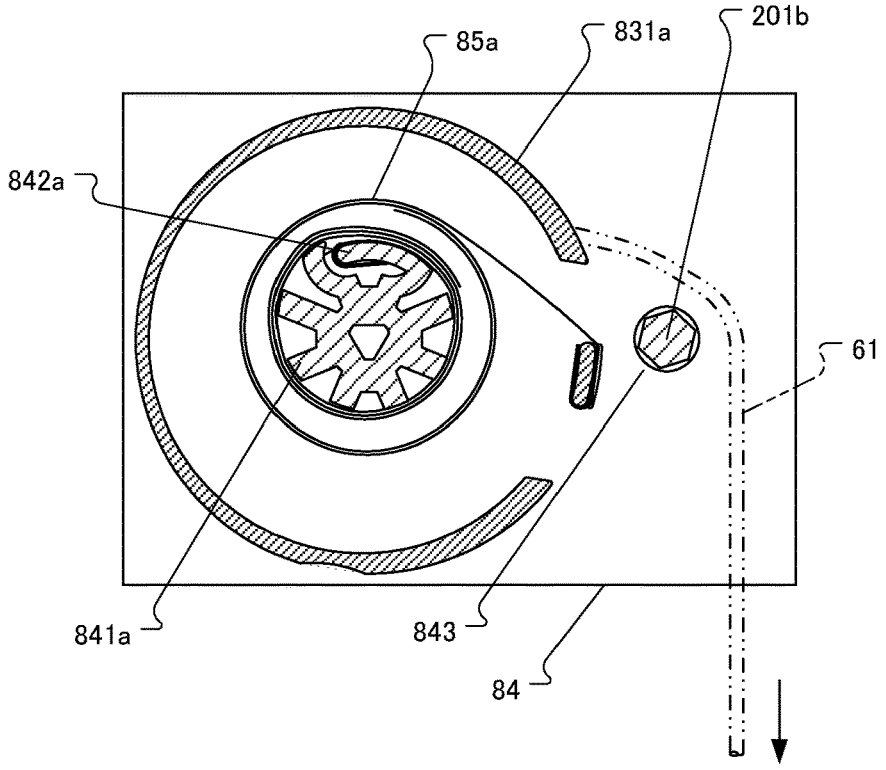
Figure 32A:
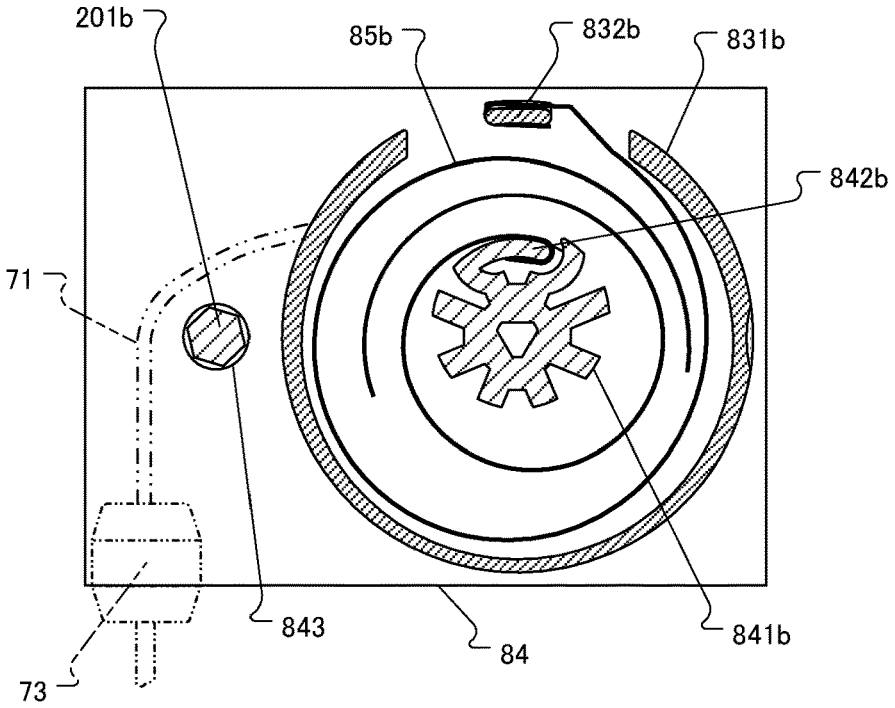
FIG. 32(*a*) is a cross-sectional view taken along line B-B of FIG. 27 showing a non-operation state of the second operation cord.
Figure 32B:
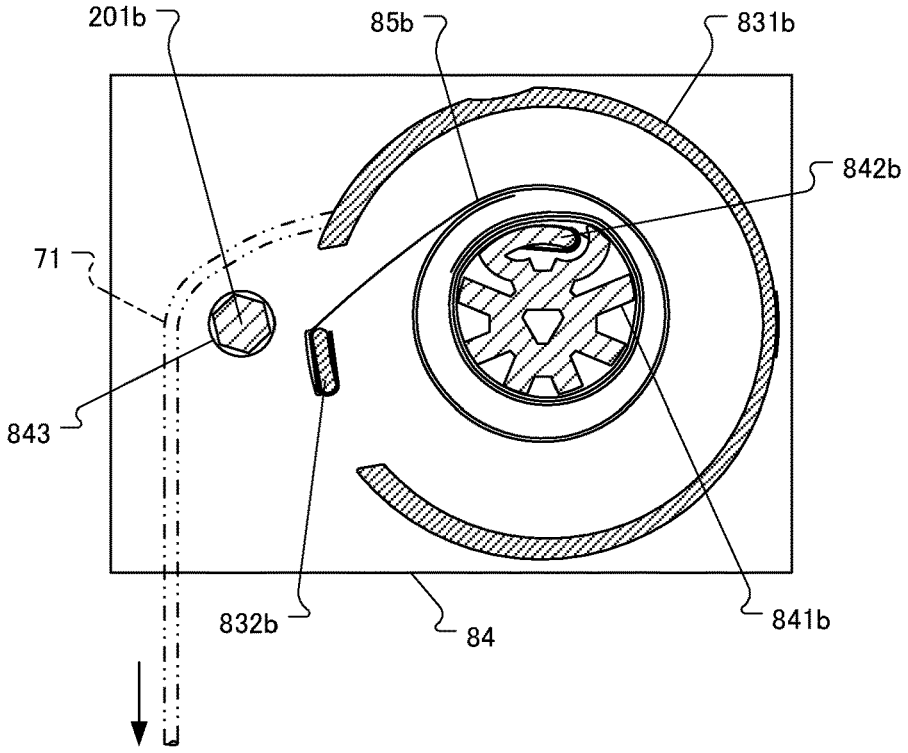
Figure 33:
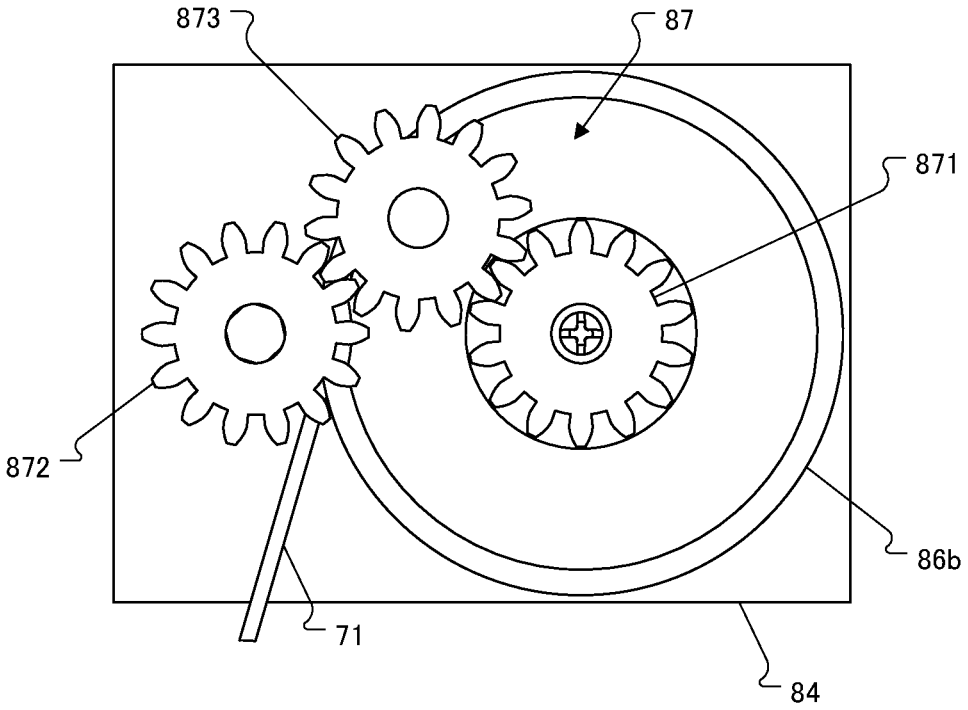
FIG. 33 is a side view of a transmission mechanism provided to the operating device according to the second embodiment.

The operating device according to the second embodiment will be described. FIG. 26 is a schematic plan perspective view of the shading device according to the present embodiment. FIGS. 27 and 28 are respectively a plan view and a perspective view illustrating the configuration of the operating device according to the present embodiment. FIGS. 29 and 30 are exploded perspective views of the operation device viewed from the first interlocking member side and the second interlocking member side, respectively. FIG. 31 is a cross-sectional view taken along line A-A of FIG. 27, in which (a) shows the non-operation state of the first operation cord, and (b) shows the operation state of the first operation cord. FIG. 32 is a cross-sectional view taken along line B-B of FIG. 27, in which (a) shows the non-operation state of the second operation cord, and (b) shows the operation state of the second operation cord. FIG. 33 is a side view of the transmission mechanism provided to the operating device.

The shading device 1*a* according to this embodiment differs from the first embodiment in that, as shown in FIG. 26, the operation device 8 is provided instead of the operation device 5. As shown in FIGS. 27 to 30, the operating device 8 includes, as drive mechanism, a first pulley 83*a*, a second pulley 83*b*, a support member 84, a first urging member 85*a*, a second urging member 85*b*, a first interlocking member 86*a*, a second interlocking member 86*b*, and a transmission mechanism 87. The first pulley 83*a*, the first urging member 85*a*, and the first interlocking member 86*a* are independently connected to the first drive system described above, and the second pulley 83*b*, the second urging member 85*b*, the second interlocking member 86*b*, and the transmission mechanism 87 are independently connected to the second drive system described above.

The first pulley 83*a* is connected to one end of the cord member 61, and the cord member 61 is wound around the circumferential wall of the first pulley 83*a* so as to be wound around and unwound from the first pulley 83*a*. In this embodiment, the cord member 61 is wound so as to be hung from the front in the front-rear direction. On one side of the first pulley 83*a*, on the right side in the left-right direction in this embodiment, a surrounding portion 831*a* is provided so as to surround and cooperatively accommodate the first urging member 85*a* with the support member 84. A portion of the circumferential wall forming the surrounding portion 831*a* is separated and serves as an outer locking portion 832*a* for detachably locking one end of the first urging member 85*a*. The first pulley 83*a* is supported by a first support shaft 841*a* of the support member 84 described later so as to be relatively rotatable, and rotates in response to the pulling down of the cord member 61.

The second pulley 83*b* is connected to one end of the cord member 71, and the cord member 71 is wound around the circumferential wall of the second pulley 83*b* so as to be wound around and unwound from the second pulley 83*b*. The second pulley 83*b* is rotatably supported by a second support shaft 841*b* of the support member 84 described later and rotates in response to the pulling down of the cord member 71. The second pulley 83*b* has the same configuration as the first pulley 83*a* and is provided with a surrounding portion 831*b* corresponding to the surrounding portion 831*a* and an outer locking portion 832*b* corresponding to the outer locking portion 832*a* described above.

The first pulleys 83*a* and the second pulleys 83*b* in this embodiment are arranged side by side along the left-right direction so as to be substantially plane-symmetrical with respect to the support member 84, where the first pulley 83*a* and the second pulley 83*b* face each other at their surrounding portions and their rotational axes are coaxial. The first pulley 83*a* transmits a rotational force to the left of the left-right direction, and the second pulley 83*b* transmits a rotational force to the right of the left-right direction.

The support member 84 is a plate-like member disposed between the first pulley 83*a* and the second pulley 83*b* and fixed to the inner wall of a case 80 containing the operation device 8. The support member 84 extends in a direction perpendicular to the left-right direction, and is provided with the above-described first support shaft 841*a* and second support shaft 841*b* each projecting in the out-of-plane direction on the both surfaces. The first support shaft 841*a* rotatably supports the first pulley 83*a* at its distal end, and an inner locking portion 842*a* is formed at its rear end, i.e., its root portion. The second support shaft 841*b* rotatably supports the second pulley 83*b* at its distal end, and an inner locking portion 842*b* is formed at its rear end.

As shown in FIG. 31(*a*), the inner locking portion 842*a* extends in the front-rear direction and is curved in the circumferential direction. The front side of the inner locking portion 842*a* in the front-rear direction is connected to the first support shaft 841*a*, and the inner locking portion 842*a* locks the first urging member 85*a* when the other end of the first urging member 85*a* is wound around the surface thereof. As shown in FIG. 32(*a*), the inner locking portion 842*b* has the same shape as the inner locking portion 842*a*, and locks the second urging member 85*b* when the other end of the second urging member 85*b* is wound around the surface thereof. The inner locking portions 842*a* and 842*b* lock the other ends of the urging members in a simple manner such that the other ends of the urging members are wound around the inner locking portions. This configuration allows the urging members to be easily detachable. This also applies to the outer locking portions 832*a* and 832*b* described above.

In this embodiment, the first urging member 85*a* and the second urging member 85*b* are wound in the same direction, and thus the inner locking portions 842*a* and 842*b* are formed so as to be plane-symmetrical with each other. The inner locking portions 842*a* and 842*b* are not limited to this shape, but may have any direction to extend and shape if the urging member can be locked. For example, the rear side of the inner locking portion in the front-rear direction may be connected to the support shaft, or the inner locking portion may be separated from the support shaft. In the former case, the urging member may be reversely wound as in the present embodiment, and in the latter case, the urging member may have a variable winding direction depending on the situation.

As described above, in this embodiment, the support member 84 supports the first pulley 83*a* and the second pulley 83*b*, and the first urging member 85*a* and the second urging member 85*b*, respectively, using one member each. The second driving shaft 201*b* is disposed in front of the first driving shaft 201*a*, and thus the support member 84 has an insertion hole 843 for inserting the second driving shaft 201*b*. If interference with the second driving shaft 201*b* is avoidable, instead of the insertion hole 843, a slit may be provided or the length of the support members 84 in the front-rear direction may be reduced.

As shown in FIGS. 29 and 31(*a*), the first urging member 85*a* is a spiral spring and is contained in the surrounding portion 831*a* of the first pulley 83*a*. Specifically, in a state of being wound as shown in FIG. 31(*a*), one end of the first urging member 85*a* is wound on the outer locking portion 832*a* of the first pulley 83*a* to be locked, and the other end is wound on the inner locking portion 842*a* of the first support shaft 841*a* to be locked. With this configuration, the first urging member 85*a* always urges the first pulley 83*a* to rotate in the winding direction of the first operation cord 6, but the stopper 63 prevents the first operation cord 6 from being wound by a predetermined amount or more. When the first operation cord 6 is pulled down in this state, as shown in FIG. 31(*b*), the first pulley 83*a* rotates in the unwinding direction, and the first urging member 85*a* gradually reduces in the diameter according to the rotation, and the rotation is stopped in a state where the first urging member 85*a* is wound to the limit at the rear end of the first support shaft 841*a*.

As shown in FIGS. 30 and 32(*a*), the second urging member 85*b* has the same configuration as the first urging member 85*a*, and is contained in the surrounding portion 831*b* of the second pulley 83*b*, and locked by the outer locking portion 832*b* of the second pulley 83*b* and the inner locking portion 842*b* of the second support shaft 841*b*. As shown in FIG. 30, similarly to the second pulley 83*b* and the cord member 821*b*, the second urging member 85*b* is disposed in the second pulley 83*b* in a state of being wound so as to be plane-symmetrical with the first urging member 85*a* with the support member 84 in between, and always urges the second pulley 83*b* to rotate in the winding direction. Accordingly, as shown in FIG. 32(*b*), similarly to the first urging member 85*a*, when the second operation cord 7 is pulled down, the second urging member 85*b* gradually reduces in diameter according to the rotation of the first pulley 83*a*, and the rotation is stopped in a state where the second urging member 85*b* is wound to the limit at the rear end of the second support shaft 841*b*.

As described above, in this embodiment, the first pulley 83*a* and the second pulley 83*b* are disposed so as to be substantially plane-symmetrical with respect to the support member 84. Similarly, the cord member 61 and the cord member 71 are wound so as to be substantially plane-symmetrical, and the first urging member 85*a* and the second urging member 85*b* are wound so as to be substantially plane-symmetrical, with respect to the support member 84. Accordingly, as shown in FIG. 28, the first pulley 83*a* and the second pulley 83*b* have the same winding and unwinding directions, and respectively have the cord member 61 and the cord member 71 in parallel hanging from the front in the front-rear direction.

As shown in FIGS. 29 and 30, the first interlocking member 86*a* is formed into a lid that can be mounted to cover the clutch mechanism attached to the first pulley 83*a*. A plurality of engaging projections 861*a*, which project radially inward so as to engage with and disengage from the clutch mechanism, are formed at predetermined intervals in the circumferential direction on the inner surface of the portion of the first interlocking member 86*a* where the clutch mechanism is covered. This configuration allows the first interlocking member 86*a* to rotate integrally or relative to the rotation of the first pulley 83*a*. Further, the first interlocking member 86*a* has a cylindrical projection at substantially the center of the left surface in the left-right direction. The cylindrical projection extends in the out-of-plane direction, and the first driving shaft 201*a* is inserted therein so as to integrally rotate. With this configuration, when the first interlocking member 86*a* rotates integrally with the first pulley 83*a*, the rotation thereof is transmitted to the first driving shaft 201*a*.

As shown in FIGS. 29 and 30, the second interlocking member 86*b* is formed into a lid that can be mounted to cover the clutch mechanism attached to the second pulley 83*b*, and a plurality of engaging projections 861*b* having the same function as those of the first interlocking member 86*a* are formed on the inner surface of the portion of the second interlocking member 86*b* where the clutch mechanism is covered. The second interlocking member 86*b* has a first gear 871 of the transmission mechanism 87 at substantially the center of the right surface in the left-right direction, and integrally rotates with the first gear 871 at the same rotation axis.

As shown in FIG. 33, the transmission mechanism 87 includes the first gear 871 rotatably coupled with the second interlocking member 86*b*, a second gear 872 rotatably coupled with the second driving shaft 201*b*, and a third gear 873 disposed between the first gear 871 and the second gear 872 and engaged with each gear to transfer the rotational force of the first gear 871 to the second gear 872. The transmission mechanism 87 is disposed between the second pulley 83*b* and the second driving shaft 201*b*, whereby the rotation of the second pulley 83*b* is converted to a rotation of the axial position at substantially the same position as the second driving shaft 201*b* and transmitted to the second driving shaft 201*b*.

Third Embodiment

Figure 34:
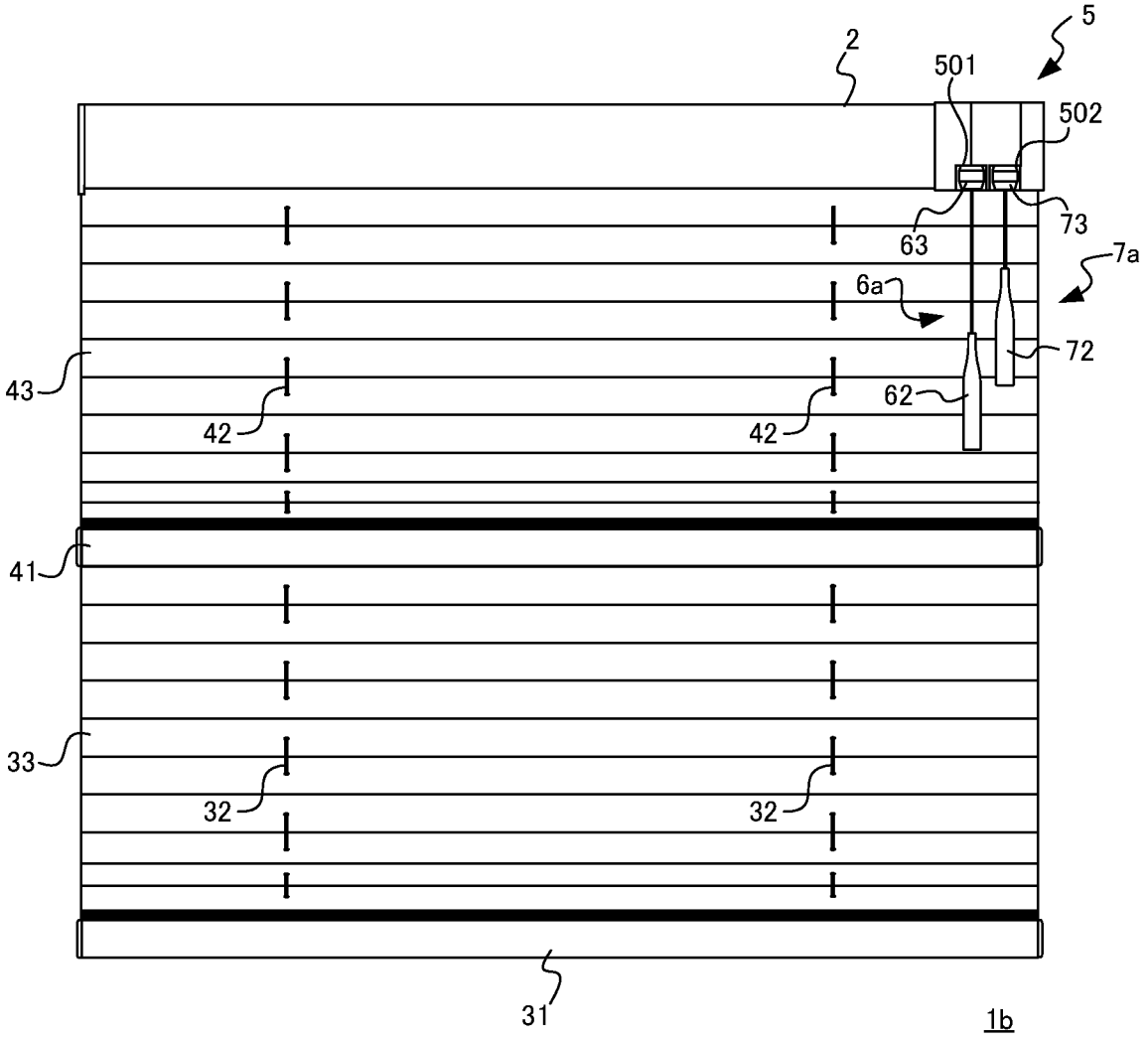
FIG. 34 is a front view showing a configuration of the shading device according to a third embodiment.

The shading device according to a third embodiment will be described. FIG. 34 is a front view illustrating a configuration of a shading device according to the present embodiment.

As shown in FIG. 34, a shading device 1*b* according to the present embodiment differs from the shading device 1 according to the first embodiment in that the shading device 1*b* includes a first operation cord 6*a* and a second operation cord 7*a* instead of the first operation cord 6 and the second operation cord 7. The first operation cord 6*a* and the second operation cord 7*a* are configured such that a distance between a gripping portion 62 and a stopper 63 is different from a distance between a gripping portion 72 and a stopper 73. Specifically, the distance between the gripping portion 62 and the stopper 63 is longer than the distance between the gripping portion 72 and the stopper 73, whereby the gripping portion 62 is positioned below the gripping portion 72 in a non-operational state.

As described above, the positional relationship between the gripping portion 62 and the gripping portion 72 in the vertical direction in a non-operation state corresponds to the positional relationship between the bottom rail 31 and the intermediate bar 41, which are to be operated by the first operation cord 6*a* and the second operation cord 7*a*, respectively. This allows the operator to easily understand which of the bottom rail 31 and the intermediate bar 41 is operated for each of the first operation cords 6*a* and the second operation cord 7*a*.

The present invention may be embodied in a variety of other forms without departing from the spirit of the invention. Therefore, the foregoing first to third embodiments have been presented by way of example in all respects, and should not be construed in a limited way. The scope of the present invention is indicated by the appended claims rather than by the foregoing description. Further, all modifications, various improvements, substitutions and changes belonging to the equivalent scope of the accompanying claims are within the scope of the present invention.

In the three embodiments described above, the first moving member moved by the rotation of the first driving shaft 201*a* and the second moving member moved by the rotation of the second driving shaft 201*b* are respectively referred to as the bottom rail 31 and the intermediate bar 41 each being moved in the vertical direction. However, the movement direction of the first moving member and the second moving member may be any direction, and the first moving member and the second moving member may be disposed in the front-rear direction and move in the vertical direction or the left-right direction, respectively. Further, the pleated screen is described as an example of the shading device, although the shading devices may be applied to shading devices such as blinds, curtains, and partitions, including horizontal blinds, vertical blinds, roll screens, honeycomb screens, tucking curtains, and accordion doors, for example.

LIST OF REFERENCE NUMERALS

1 shading device
31 first moving member
41 second moving member
51 first pulley
52 second pulley
57 urging member
201*a* first driving shaft
201*b* second driving shaft

What is claimed is:

1. A shading device comprising a first driving shaft that is rotatably supported within a headbox and configured to drive a first moving member and a second driving shaft that is rotatably supported within the headbox and configured to drive a second moving member, the first moving member and the second moving member configured to move relative to the headbox, the shading device comprising:

a first pulley that drives the first driving shaft;

a second pulley that is disposed at a position different from the first pulley in a longitudinal direction of the headbox and drives the second driving shaft, wherein a rotational axis of the first pulley and a rotational axis of the second pulley are substantially coaxial, the first pulley and the second pulley being disposed in parallel along the longitudinal direction; and an urging member that is disposed between the first pulley and the second pulley in the longitudinal direction and configured to apply a rotational force to at least one of the first pulley or the second pulley.

2. The shading device according to claim 1, wherein:

the urging member is a spring, a first locking portion for locking one end of the spring is disposed on the first pulley, and a second locking portion for locking a second end of the spring is disposed on the second pulley.

3. The shading device according to claim 1, wherein:

the urging member is a spiral-wound spring and disposed between the first pulley and the second pulley so as to be wound around a support shaft formed in either the first pulley or the second pulley as a central axis.

4. The shading device according to claim 1, further comprising:

a first operation cord that is disposed so as to be wound around the first pulley; and a second operation cord that is disposed so as to be wound around the second pulley, wherein:

a winding direction of the first operation cord by the first pulley and a winding direction of the second operation cord by the second pulley are opposite to each other, the first pulley is restricted from winding equal to or more than a predetermined amount of the first operation cord, and the second pulley is restricted from winding equal to or more than a predetermined amount of the second operation cord.

5. The shading device according to claim 1, further comprising a transmission mechanism that transmits a rotational force of the second pulley to the second driving shaft, wherein:

the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

6. The shading device according to claim 2, wherein:

the urging member is a spiral-wound spring and disposed between the first pulley and the second pulley so as to be wound around a support shaft formed in either the first pulley or the second pulley as a central axis.

7. The shading device according to claim 2, further comprising:

a first operation cord that is disposed so as to be wound around the first pulley; and a second operation cord that is disposed so as to be wound around the second pulley, wherein:

a winding direction of the first operation cord by the first pulley and a winding direction of the second operation cord by the second pulley are opposite to each other, the first pulley is restricted from winding equal to or more than a predetermined amount of the first operation cord, and the second pulley is restricted from winding equal to or more than a predetermined amount of the second operation cord.

8. The shading device according to claim 2, further comprising a transmission mechanism that transmits a rotational force of the second pulley to the second driving shaft, wherein:

the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

9. The shading device according to claim 7, wherein:

the urging member applies a rotating force in the winding direction of the first operation cord to the first pulley and applies a rotating force in the winding direction of the second operation cord to the second pulley.

10. The shading device according to claim 3, further comprising:

a first operation cord that is disposed so as to be wound around the first pulley; and a second operation cord that is disposed so as to be wound around the second pulley, wherein:

a winding direction of the first operation cord by the first pulley and a winding direction of the second operation cord by the second pulley are opposite to each other, the first pulley is restricted from winding equal to or more than a predetermined amount of the first operation cord, and the second pulley is restricted from winding equal to or more than a predetermined amount of the second operation cord.

11. The shading device according to claim 3, further comprising a transmission mechanism that transmits a rotational force of the second pulley to the second driving shaft, wherein:

the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

12. The shading device according to claim 10, wherein:

the urging member applies a rotating force in the winding direction of the first operation cord to the first pulley and applies a rotating force in the winding direction of the second operation cord to the second pulley.

13. The shading device according to claim 4, wherein:

the urging member applies a rotating force in the winding direction of the first operation cord to the first pulley and applies a rotating force in the winding direction of the second operation cord to the second pulley.

14. The shading device according to claim 4, further comprising a transmission mechanism that transmits a rotational force of the second pulley to the second driving shaft, wherein:

the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

15. The shading device according to claim 13, further comprising a transmission mechanism that transmits a rotational force of the second pulley to the second driving shaft, wherein:

the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

16. A shading device comprising a first driving shaft that is rotatably supported within a headbox and configured to drive a first moving member and a second driving shaft that is rotatably supported within the headbox and configured to drive a second moving member, the first moving member and the second moving member configured to move relative to the headbox, the shading device comprising:

a first pulley that drives the first driving shaft;

a second pulley that is disposed at a position different from the first pulley in a longitudinal direction of the headbox and drives the second driving shaft; and a transmission mechanism that transmits a rotational force of the second pulley to the second driving shaft, wherein:

a rotational axis of the first pulley and a rotational axis of the second pulley are substantially coaxial, the first pulley and the second pulley are disposed in parallel along the longitudinal direction, the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

17. A shading device comprising a first driving shaft that is rotatably supported within a headbox and configured to drive a first moving member and a second driving shaft that is rotatably supported within the headbox and configured to drive a second moving member, the first moving member and the second moving member configured to move relative to the headbox, the shading device comprising:

a first pulley that drives the first driving shaft;

a second pulley that is disposed at a position different from the first pulley in a longitudinal direction of the headbox and drives the second driving shaft;

an urging member that is disposed between the first pulley and the second pulley in the longitudinal direction and configured to apply a rotational force to at least one of the first pulley or the second pulley; and a transmission mechanism that transmits a rotational force of the second pulley to the second driving shaft, wherein:

the first driving shaft and the second driving shaft are disposed in parallel so that a position of an axial center of the first driving shaft is different from a position of an axial center of the second driving shaft in an orthogonal direction perpendicular to the longitudinal direction, a position of an axial center of the second pulley is different from the position of the axial center of the second driving shaft in the orthogonal direction, and the transmission mechanism converts a rotation around the axial center of the second pulley to a rotation around the axial center of the second driving shaft and transmits the converted rotation to the second driving shaft.

18. The shading device according to claim 17, wherein:

the urging member is a spring, a first locking portion for locking one end of the spring is disposed on the first pulley, and a second locking portion for locking a second end of the spring is disposed on the second pulley.

19. The shading device according to claim 17, wherein:

the urging member is a spiral-wound spring and disposed between the first pulley and the second pulley so as to be wound around a support shaft formed in either the first pulley or the second pulley as a central axis.

20. The shading device according to claim 17, further comprising:

a first operation cord that is disposed so as to be wound around the first pulley; and a second operation cord that is disposed so as to be wound around the second pulley, wherein:

a winding direction of the first operation cord by the first pulley and a winding direction of the second operation cord by the second pulley are opposite to each other, the first pulley is restricted from winding equal to or more than a predetermined amount of the first operation cord, and the second pulley is restricted from winding equal to or more than a predetermined amount of the second operation cord.

* * * * *